US009220162B2

(12) United States Patent
Takenoshita et al.

(10) Patent No.: US 9,220,162 B2
(45) Date of Patent: Dec. 22, 2015

(54) PLASMA GENERATING APPARATUS AND PLASMA GENERATING METHOD

(75) Inventors: Kazutoshi Takenoshita, Yokohama (JP); Makoto Miyamoto, Yokohama (JP); Seiro Yuge, Yokohama (JP); Yukika Yamada, Yokohama (JP); Yoko Nakayama, Yokohama (JP); Yuki Kumagai, Yokohama (JP)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 287 days.

(21) Appl. No.: 13/371,997

(22) Filed: Feb. 13, 2012

(65) Prior Publication Data

US 2012/0229029 A1 Sep. 13, 2012

(30) Foreign Application Priority Data

| | | |
|---|---|---|
| Mar. 9, 2011 | (JP) | 2011-052233 |
| Mar. 9, 2011 | (JP) | 2011-052234 |
| Apr. 19, 2011 | (JP) | 2011-093103 |
| Oct. 25, 2011 | (KR) | 10-2011-0109432 |

(51) Int. Cl.
*H01J 7/24* (2006.01)
*H05H 1/24* (2006.01)

(52) U.S. Cl.
CPC ..... *H05H 1/2406* (2013.01); *H05H 2001/2412* (2013.01); *H05H 2245/1225* (2013.01)

(58) Field of Classification Search
CPC ..... B01D 53/52; H05H 1/24
USPC ..... 315/111.21
See application file for complete search history.

(56) References Cited

U.S. PATENT DOCUMENTS

| | | | | |
|---|---|---|---|---|
| 5,354,413 | A * | 10/1994 | Smesny et al. | 156/345.47 |
| 6,049,086 | A * | 4/2000 | Foggiato et al. | 250/504 R |
| 6,118,218 | A * | 9/2000 | Yializis et al. | 315/111.21 |
| 6,318,382 | B1 * | 11/2001 | Katagiri et al. | 134/1.3 |
| 6,406,759 | B1 * | 6/2002 | Roth | 427/562 |
| 6,557,569 | B2 * | 5/2003 | Katagiri et al. | 134/25.4 |
| 6,724,148 | B1 * | 4/2004 | Gonzalez et al. | 315/111.21 |
| 6,818,193 | B2 * | 11/2004 | Christodoulatos et al. | 423/210 |
| 7,042,159 | B2 * | 5/2006 | Tanaka et al. | 315/111.21 |
| 7,083,702 | B2 * | 8/2006 | Blonigan et al. | 156/345.47 |
| 7,192,553 | B2 * | 3/2007 | Crowe et al. | 422/23 |
| 7,381,292 | B2 * | 6/2008 | Lee et al. | 156/345.48 |

(Continued)

FOREIGN PATENT DOCUMENTS

| | | |
|---|---|---|
| JP | 2001-210448 | 8/2001 |
| JP | 2002-224211 | 8/2002 |

(Continued)

OTHER PUBLICATIONS

Japanese Office Action issued Jun. 3, 2014 in corresponding Japanese Application No. JP2011-052233.

*Primary Examiner* — Tung X Le
*Assistant Examiner* — Srinivas Sathiraju
(74) *Attorney, Agent, or Firm* — Staas & Halsey LLP

(57) ABSTRACT

Generated amount of active species is increased, and dew formation or moisture attachment hardly occurs on a dielectric layer. A plasma generating apparatus including a pair of electrodes, wherein a dielectric layer is arranged on at least one of surfaces of the electrodes facing each other, plasma discharge occurs as a predetermined voltage is applied to the electrodes, and a coating film is arranged on a surface of the dielectric layer.

33 Claims, 25 Drawing Sheets

(56) References Cited

U.S. PATENT DOCUMENTS

| | | | | |
|---|---|---|---|---|
| 7,453,191 | B1 * | 11/2008 | Song | 313/231.31 |
| 7,854,900 | B2 * | 12/2010 | Takeda et al. | 422/120 |
| 7,931,811 | B2 * | 4/2011 | Ruan et al. | 210/748.01 |
| 8,017,408 | B2 * | 9/2011 | Meinhart et al. | 436/168 |
| 8,222,822 | B2 * | 7/2012 | Gilbert | 315/111.51 |
| 8,247,238 | B2 * | 8/2012 | Meinhart et al. | 436/168 |
| 8,303,765 | B2 * | 11/2012 | Okita et al. | 156/345.48 |
| 8,314,560 | B2 * | 11/2012 | Nakagami et al. | 315/111.21 |
| 8,344,627 | B1 * | 1/2013 | Hooke et al. | 315/111.21 |
| 8,415,885 | B2 * | 4/2013 | Yamazawa | 315/111.51 |
| 8,431,409 | B1 * | 4/2013 | Meinhart et al. | 436/168 |
| 8,723,423 | B2 * | 5/2014 | Hoffman et al. | 315/111.51 |
| 8,729,805 | B2 * | 5/2014 | Yagi et al. | 315/111.21 |
| 8,928,230 | B2 * | 1/2015 | Watson et al. | 315/111.91 |
| 2001/0014540 | A1 * | 8/2001 | Shan et al. | 438/710 |
| 2003/0030374 | A1 * | 2/2003 | Pai | 313/582 |
| 2003/0051993 | A1 * | 3/2003 | Ricatto et al. | 204/165 |
| 2003/0072675 | A1 | 4/2003 | Takeda et al. | |
| 2003/0121906 | A1 * | 7/2003 | Abbott et al. | 219/543 |
| 2004/0037756 | A1 * | 2/2004 | Houston et al. | 422/186.04 |
| 2004/0149733 | A1 * | 8/2004 | Abbott et al. | 219/535 |
| 2005/0179395 | A1 * | 8/2005 | Pai | 315/111.21 |
| 2006/0130971 | A1 * | 6/2006 | Chang et al. | 156/345.48 |
| 2008/0063577 | A1 * | 3/2008 | Crowe et al. | 422/186.04 |
| 2010/0320916 | A1 * | 12/2010 | Yagi et al. | 315/111.21 |
| 2011/0135844 | A1 * | 6/2011 | Sorensen et al. | 427/578 |
| 2011/0287193 | A1 * | 11/2011 | Creyghton et al. | 427/569 |
| 2013/0053760 | A1 * | 2/2013 | Ehlbeck et al. | 604/23 |
| 2013/0189156 | A1 * | 7/2013 | Keener et al. | 422/29 |
| 2014/0210345 | A1 * | 7/2014 | Hoffman | 315/111.21 |

FOREIGN PATENT DOCUMENTS

| | | |
|---|---|---|
| JP | 2003-79714 | 3/2003 |
| JP | 2004-105517 | 4/2004 |
| JP | 2006-120578 | 5/2006 |
| JP | 2007-294180 | 11/2007 |
| JP | 2009-081134 | 4/2009 |

* cited by examiner

PLASMA GENERATING APPARATUS AND PLASMA GENERATING METHOD

CROSS-REFERENCE TO RELATED APPLICATIONS

This application claims the benefit of Japanese Patent Application No. 2011-052233, filed on Mar. 9, 2011, Japanese Patent Application No. 2011-052234, filed on Mar. 9, 2011, and Japanese Patent Application No. 2011-093103, filed on Apr. 19, 2011, in the Japanese Patent Office, and Korean Patent Application No. 10-2011-0109432, filed on Oct. 25, 2011, in the Korean Intellectual Property Office, the disclosures of which are incorporated herein in their entirety by reference.

BACKGROUND

1. Field

The present invention relates to a plasma generating apparatus and a plasma generating method.

2. Description of the Related Art

Recently, the demand for air quality controls in living environments, such as sterilization and deodorization, is increasing due to an increase in symptoms like atopy, asthma, and allergies and an increase in the risk of infections such as new influenza in the population. Furthermore, as living conditions become more and more affluent, the amount of stored food or chances of storing uneaten foods increases, and thus it has become more and more important to control environments in food storage devices, such as refrigerators.

Related arts for controlling air quality in living environments are generally related to physical controls, such as filters. Relatively large dusts and particles floating in the air may be trapped by using physical controls. Depending on the size of filter holes, germs or viruses may also be trapped by using physical controls. Furthermore, in a case of physical control unit having innumerable absorption sites, such as activated carbon, even malodor molecules may be trapped. However, to trap such malodor molecules, it is necessary to transmit all the air in a space to be controlled through a filter, thus resulting in an increase in the size of a device and maintenance costs for filter replacements. Furthermore, such physical control is ineffective against malodor molecules attached to something. Therefore, an example of means for sterilizing or deodorizing malodor molecules attached to something is to release chemically active species into a space to be sterilized or deodorized. For spraying chemicals, air fresheners, or deodorizers, it is necessary to prepare the chemically active species in advance, and thus it is inevitable to periodically restock such chemically active species. Recently, methods for generating plasma in the air and sterilizing or deodorizing by using chemically active species generated therefrom are becoming popular.

Methods for generating plasma in the air by using electric discharge and sterilizing or deodorizing by using ions or radicals (referred to hereinafter as "chemically active species") generated therefrom may be categorized into two types:

(1) So-called passive plasma generating apparatuses which make germs or viruses floating in the air (referred to hereinafter as "floating germs") or malodorous substances (referred to hereinafter as "malodors") react with active species within a space with limited volume within the passive plasma generating apparatuses (e.g., Patent Reference 1).

(2) So-called active plasma generating apparatuses which spray active species generated by a plasma generating unit into a closed space with a volume larger than that in (1) above (e.g., living room, bathroom, interior of a vehicle, etc.), such that the active species in the art collide and react with floating germs or malodors in the art (e.g., Patent Reference 2).

Since a passive plasma generating apparatus of (1) generates plasma within a relatively small volume, active species are densely generated and thus highly effective sterilization and deodorization may be expected. However, since it is necessary to introduce floating germs or malodors into the passive plasma generating apparatus, the size of the plasma generating apparatus is relatively large. Furthermore, ozone may be easily generated as a by-product of the plasma generation, and thus, it is necessary to additionally install a filter for absorbing or decomposing ozone to prevent ozone from leaking out of the plasma generating apparatus.

On the other hand, an active plasma generating apparatus of (2) may be manufactured to have a relatively small size, and not only sterilization of floating germs and decomposition of malodors in the art, but also sterilization of germs attached to surfaces of clothing or household items (referred to hereinafter as "attached germs") and decomposition of malodors attached to surfaces of clothing or household items may be expected. However, since active species spread into a closed space that is excessively large compared to the volume of the active surfaces of clothing or household items, the concentration of the active species decreases, and thus, a sterilization or deodorization effect may only be expected with active species having a relatively long lifespan. Therefore, little deodorization effect may be expected in a space with a high concentration of malodors (concentration that is about 10,000 times the concentration of active species).

As described above, a passive plasma generating apparatus is only effective against floating germs or malodors contained in the air flowing into the passive plasma generating apparatus, whereas an active plasma generating apparatus is practically only effective against floating germs, attached germs, and malodors with relatively low concentrations. In other words, a function of the related art is restricted only one of "sterilization and deodorization of floating germs" or "sterilization of floating germs and attached germs with relatively low concentrations and deodorization of floating and attached malodors with relatively low concentrations".

Furthermore, electrodes constituting a plasma generating unit commonly employ porous dielectric layers, for example, at portions of the electrodes at which plasma is generated. Therefore, under conditions of high humidity, moisture absorption of a dielectric layer changes the electric properties of the dielectric layer, and thus the generation of plasma is diminished. Particularly, in an environment with a low temperature and changeable humidity, such as a refrigerator, dew may easily condense on the dielectric layers of the electrodes. As a result, plasma generation is stopped and the efficiencies of sterilization and deodorization deteriorate. Therefore, if high humidity is maintained in a refrigerator, it is difficult to maintain the efficiency of sterilization.

PRIOR ART REFERENCES

1. Japanese Patent Laid-Open Publication No. 2002-224211
2. Japanese Patent Laid-Open Publication No. 2003-79714

SUMMARY

Additional aspects and/or advantages will be set forth in part in the description which follows and, in part, will be apparent from the description, or may be learned by practice of the invention.

The present embodiments provides a technique for simultaneously embodying sterilization and deodorization of attached germs by combining a passive mechanism for performing deodorization by using active species generated by generating plasma and an active mechanism for sterilizing attached germs by emitting the active species to outside of an apparatus for sterilization and deodorization by combining by increasing the amount of the generated active species and preventing dew condensation or moisture absorption at dielectric layers.

The present embodiments also provide a technique for improving the drying efficiency stabilizing the generated amount of active species by stabilizing plasma generation by improving the drying efficiency of dielectric layers.

According to an aspect, there is provided a plasma generating apparatus including a pair of electrodes, wherein a dielectric layer is arranged on at least one of surfaces of the electrodes facing each other, plasma discharge occurs as a predetermined voltage is applied to the electrodes, and a coating film is arranged on a surface of the dielectric layer.

A coating film is arranged on a surface of the dielectric layer, dew condensation and moisture attachment hardly occur on the dielectric layer, and thus deterioration of sterilizing efficiency under high humidity inside a refrigerator, for example, may be prevented. As a result, sterilizing efficiency may be maintained for an extended period of time. Furthermore, as fluid flowing holes are formed in portions respectively corresponding to electrodes to penetrate through the electrodes, amount of plasma generated at the corresponding fluid flowing holes may be maximized, and an area by which the plasma and fluid contact each other may be maximized. Therefore, the generated amount of active species (ions and radicals) may be increased, and the effects of deodorizing by using the active species and sterilizing floating germs and attached germs by emitting the active species to outside of a plasma generating apparatus may be sufficiently high. Furthermore, the term 'portions corresponding to electrodes' means that fluid flowing holes formed in each of electrodes are located at substantially same locations when viewed from above. In other words, the fluid flowing holes are formed to have substantially same (x, y) coordinates at each of the electrodes when viewed in a z-axis direction in the rectangular coordinate system.

If the dielectric layer is formed using a thermal spraying method, the dielectric layer acquires a porous structure or a structure having fine protrusions and recessions, and thus the dielectric layer may be vulnerable to humidity. Therefore, effect of arranging a coating film becomes more significant.

For further reducing dew condensation and moisture attachment, the coating film may be water-repellent.

A thickness of the coating film may be from about 0.01 μm to about 100 μm. If the thickness of the coating film exceeds 100 μm, material properties of the dielectric layer are deteriorated. Furthermore, protrusions and recessions formed on a surface of the dielectric layer are buried, and thus plasma generating efficiency is lowered.

The plasma generating apparatus may further include a spacer, which is arranged between the pair of electrodes and has a thickness smaller than or equal to 500 μm. By forming the spacer, a distance between electrodes may be increased, and thus deodorizing reacting field may become larger. As a result, deodorizing efficiency may increase. Furthermore, since distance between electrodes increases as the spacer is formed, even if moisture is attached, only fine water drops are formed, and thus it is easy to drain the moisture. Here, methods for forming the spacer may include deposition, chemical vapor deposition (CVD), sputtering, or ion plating, a plating method, a thermal spraying method, a spray coating method, a spin coating method, or an application method.

A coating film may be arranged on a surface of the spacer to prevent dew condensation and moisture attachment at the spacer.

For efficient flow of fluid through fluid flowing holes to accelerate generation of active species and to improve deodorizing efficiency, an air-blowing mechanism for forcibly blows wind toward the fluid flowing holes may be further arranged.

Velocity of the wind which is blown by the air-blowing mechanism and passes through the fluid flowing holes may be from about 0.1 m/s to about 30 m/s.

To maximize a number of active species contained in a fluid passing through the fluid flowing holes and to minimize generated amount of ozone, voltages to the electrodes may be applied as pulses with peak values from about 100 V to about 5000 V and pulse widths from about 0.1 μ seconds to about 300 μ seconds.

According to another aspect, there is provided a plasma generating apparatus including a pair of electrodes, wherein a dielectric layer is arranged on at least one of surfaces of the electrodes facing each other, plasma discharge occurs as a predetermined voltage is applied at the electrodes, and a heating element is arranged at each of the electrodes or the dielectric layer.

In this case, since the heating elements are arranged in the electrodes or the dielectric layers, dew condensation and moisture attachment hardly occur and, even if dew condenses or moisture is attached, the dew or moisture may be dried. For example, the deterioration of sterilizing efficiency under high humidity inside a refrigerator may be prevented, and thus sterilizing efficiency may be maintained for an extended period of time. If dew condenses on a surface of a dielectric layer and plasma generation efficiency is deteriorated, the dielectric layer may be dried as the heating elements emit heat, and thus plasma generation may be restored. Furthermore, since the heating elements are arranged in an electrode or a dielectric layer and directly heat the electrode or the dielectric layer, the period of time for heating the electrode or the dielectric layer and energy for heating the electrode or the dielectric layer may be reduced as compared to heat radiation or indirect heating. Furthermore, since an electrode or a dielectric layer is heated by using the heating elements, reactive heat for deodorizing reaction may be supplied, and thus deodorizing reaction may be accelerated. Furthermore, by forming fluid flowing holes in portions corresponding to each of electrodes to penetrate through the electrodes, amount of plasma generated at the corresponding fluid flowing holes may be maximized, and thus the area by which the plasma and fluid contact each other may be maximized. Therefore, the generated amount of active species (ions and radicals) may be increased, and the effects of deodorizing by using the active species and sterilizing floating germs and attached germs by emitting the active species to outside of the plasma generating apparatus may be sufficiently high.

Here, the heating element may be arranged in the electrode, may be arranged between the electrode and the dielectric layer, or may be arranged on a portion of surfaces of the dielectric layer.

According to another aspect, there is provided a plasma generating apparatus including a pair of electrodes; and a casing which supports the pair of electrodes, wherein a dielectric layer is arranged on at least one of surfaces of the electrodes facing each other, plasma discharge occurs as a predetermined voltage is applied to the electrodes, and a heating element for heating each of the electrodes or the dielectric layer is arranged at the casing.

Therefore, since the heating element is arranged at the casing and heats the electrodes and the dielectric layer, dew condensation and moisture attachment hardly occur and, even if dew condenses or moisture is attached, the dew or moisture may be removed.

A heating temperature of the heating element may be less than or equal to 150° C.

To prevent dew condensation and moisture attachment at a plasma generating location and to prevent deterioration of sterilizing efficiency and deodorizing efficiency by easily removing dews and moistures, a coating film may be arranged on a surface of the dielectric layer. Here, the coating film may be water-repellent. Furthermore, by using a water-repellent coating film, water-repellent malodor compounds may be easily absorbed by the coating film, and thus deodorizing efficiency may be improved.

A thickness of the coating film may be from about 0.01 μm to about 100 μm. Here, if the thickness of the coating film exceeds 100 μm, material properties of the dielectric layer are deteriorated. Furthermore, protrusions and recessions formed on a surface of the dielectric layer are buried, and thus plasma generating efficiency is lowered.

The plasma generating apparatus may further include a spacer, which is arranged between the pair of electrodes and has a thickness smaller than or equal to 500 μm. By forming the spacer, a distance between electrodes may be increased, and thus deodorizing reacting field may become larger. As a result, deodorizing efficiency may increase. Furthermore, since distance between electrodes increases as the spacer is formed, even if moisture is attached, only fine water drops are formed, and thus it is easy to drain the moisture. Here, methods for forming the spacer may include deposition, chemical vapor deposition (CVD), sputtering, or ion plating, a plating method, a thermal spraying method, a spray coating method, a spin coating method, or an application method.

For efficient flow of fluid through fluid flowing holes to accelerate generation of active species and to improve deodorizing efficiency, an air-blowing mechanism for forcibly blows wind toward the fluid flowing holes may be further arranged. Furthermore, evaporation of dew or attached moisture may be accelerated by forcibly blowing wind.

To maximize a number of active species contained in a fluid passing through the fluid flowing holes and to minimize generated amount of ozone, voltages to the electrodes may be applied as pulses with peak values from about 100 V to about 5000 V and pulse widths from about 0.1 μ seconds to about 300 μ seconds.

According to another aspect, there is provided a plasma generating apparatus including a pair of electrodes; and a casing which supports the pair of electrodes, wherein a dielectric layer is arranged on at least one of surfaces of the electrodes facing each other, plasma discharge occurs as a predetermined voltage is applied at the electrodes, fluid flowing holes are formed in each of the pair electrodes, a location of the fluid flowing holes corresponds to each other to penetrate through the electrodes, the casing opens at least a part of lateral openings formed between the pair of electrodes.

In this case, since the lateral openings formed between the pair of electrodes are at least partially opened by the casing, dew water formed in the pair of electrodes may be easily evaporated, and thus cumulative condensation of dew water in the pair of electrodes may be prevented. Therefore, the drying efficiency of the dielectric layers may be improved. As a result, generation of plasma may be stabilized, and thus the generated amount of active species may be stabilized.

Furthermore, if the casing completely covers the pair of lateral openings, dew water on a dielectric layer close to the fluid flowing holes may be dried, whereas drying efficiency of dew water on dielectric layers at other portions, such as around the pair of electrodes, is significantly low. According to the present invention, not only a dielectric layer close to the fluid flowing holes but also dielectric layers at other portions may be dried by opening the lateral openings of the electrodes.

Furthermore, by forming fluid flowing holes in portions corresponding to each of electrodes to penetrate through the electrodes, amount of plasma generated at the corresponding fluid flowing holes may be maximized, and thus the area by which the plasma and fluid contact each other may be maximized. Therefore, the generated amount of active species (ions and radicals) may be increased, and the effects of deodorizing by using the active species and sterilizing floating germs and attached germs by emitting the active species to outside of the plasma generating apparatus may be sufficiently high.

The casing may include a wall unit facing the lateral opening, and a gas flow path may be formed between the lateral opening and the wall unit. Furthermore, by forming the wall unit facing the lateral opening, sparks, which are ignited by plasma, may be prevented from being propagated to outside.

The plasma generating apparatus may further include an air-blowing mechanism, which is arranged at leading ends or rear ends of the pair of electrodes to provide air to the lateral opening. In this case, since wind may be efficiently blown to the lateral openings, moisture may be easily drained via the lateral openings, and thus drying efficiency of dielectric layers may be improved. Furthermore, due to the air-blowing mechanism, fluid may efficiently flow through fluid flowing holes, and thus generation of active species may be accelerated and deodorizing efficiency may be improved. For example, in a household appliance, such as a refrigerator, the air-blowing mechanism may be efficiently operated with minimum energy by being linked with a sensor, such as a humidity sensor or a temperature sensor. Furthermore, since dew formation may be detected by determining whether applied voltage is lowered, amount of air to blow may be adjusted based on a result of the detection.

Air blown by the air-blowing mechanism may pass through the fluid flowing holes at a velocity from about 0.1 m/s to about 30 m/s.

In a case where a dielectric layer is formed using a thermal spraying method, fine protrusions and recessions are formed on a surface of the dielectric layer and, since fine protrusions and recessions face each other, drying efficiency is significantly deteriorated. According to the present invention, the deterioration of drying efficiency may be prevented by forming the lateral openings.

To prevent dew condensation and moisture attachment at a plasma generating location and to prevent deterioration of sterilizing efficiency and deodorizing efficiency by easily removing dews and moistures, a coating film may be arranged on a surface of the dielectric layer. Here, the coating film may be water-repellent. Furthermore, by using a water-repellent coating film, water-repellent malodor compounds may be easily absorbed by the coating film, and thus deodorizing efficiency may be improved.

A thickness of the coating film may be from about 0.01 μm to about 100 μm. Here, if the thickness of the coating film exceeds 100 μm, material properties of the dielectric layer are deteriorated. Furthermore, protrusions and recessions formed on a surface of the dielectric layer are buried, and thus plasma generating efficiency is lowered.

The plasma generating apparatus may further include a spacer, which is arranged between the pair of electrodes and has a thickness smaller than or equal to 500 μm. By forming the spacer, a distance between electrodes may be increased, and thus deodorizing reacting field may become larger. As a result, deodorizing efficiency may increase. Furthermore, since distance between electrodes increases as the spacer is formed, even if moisture is attached, only fine water drops are formed, and thus it is easy to drain the moisture. Here, methods for forming the spacer may include deposition, chemical vapor deposition (CVD), sputtering, or ion plating, a plating method, a thermal spraying method, a spray coating method, a spin coating method, or an application method.

To maximize a number of active species contained in a fluid passing through the fluid flowing holes and to minimize generated amount of ozone, voltages to the electrodes may be applied as pulses with peak values from about 100 V to about 5000 V and pulse widths from about 0.1 μ seconds to about 300 μ seconds.

According to another aspect, there is provided a method of generating plasma including preparing a pair of electrodes, wherein a dielectric layer is arranged on at least one of surfaces of the electrodes facing each other; and applying a predetermined voltage to the electrodes to occur plasma discharge, wherein a coating film is arranged on a surface of the dielectric layer.

By increasing generated amount of active species, sterilization of attached germs and deodorization may be embodied at the same time. Furthermore, by removing dews formed on or moistures attached to dielectric layers, deterioration of sterilizing efficiency may be prevented for an extended period of time.

Furthermore, by increasing generated amount of active species, sterilization of attached germs and deodorization may be embodied at the same time. Furthermore, by improving drying efficiency of dielectric layers, plasma generation may be stabilized, and thus generated amount of active species may be stabilized.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Figure 1:
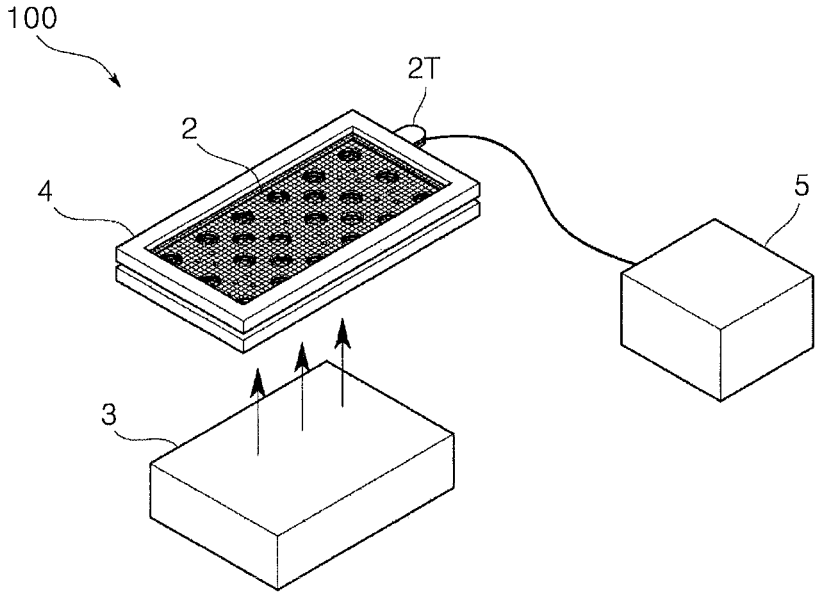
FIG. 1 is a perspective view of a plasma generating apparatus according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Hereinafter, the present invention will be described in detail by explaining preferred embodiments of the invention with reference to the attached drawings.

A plasma generating apparatus 100 according to an embodiment of the present invention is used in a household appliance, such as a refrigerator, a laundry machine, a clothes dryer, a vacuum, an air conditioner, an air cleaner, etc., for deodorizing the air inside or outside a corresponding household appliance or sterilizing floating germs or attached germs inside or outside the corresponding household appliance.

Figure 2:
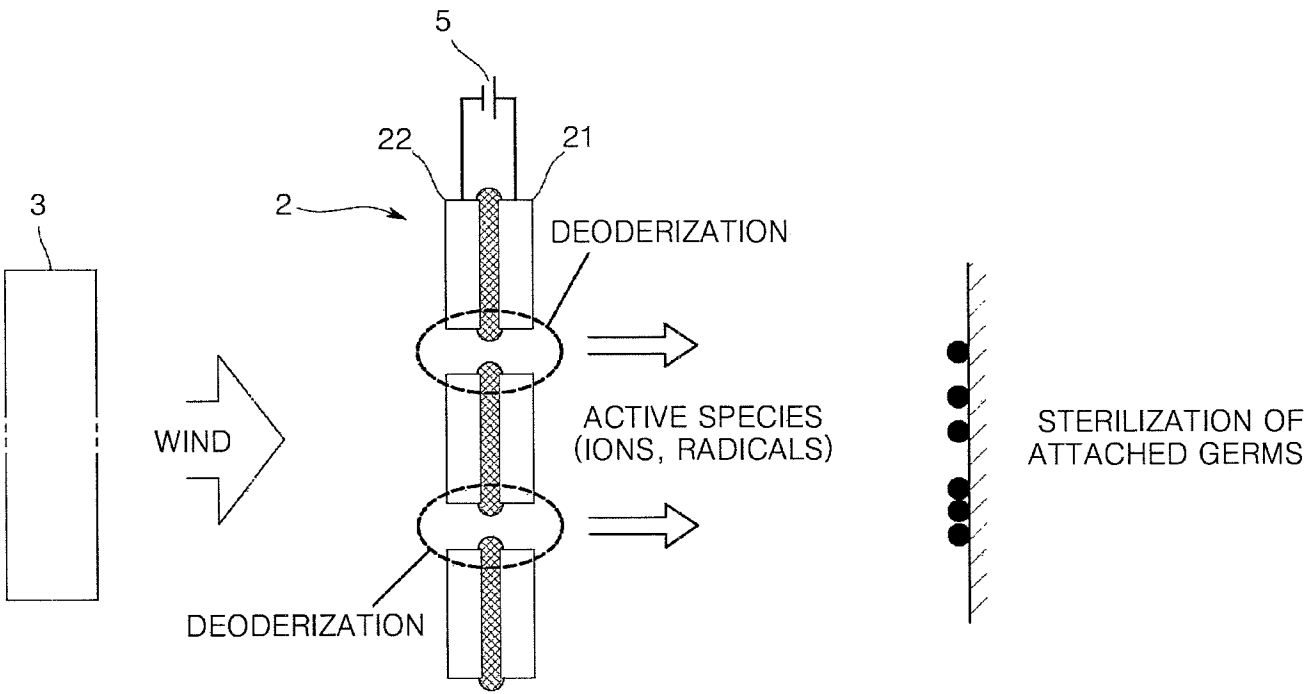
FIG. 2 is a diagram showing operation of the plasma generating apparatus.

Particularly, as shown in FIGS. 1 and 2, the plasma generating apparatus 100 includes a plasma electrode unit 2 which generates active species, such as ions or radicals, by using micro-gap plasma, an air blowing unit 3 which is installed outside the plasma electrode unit 2 and forcibly blows wind (sends air flow) toward the plasma electrode unit 2, an anti-explosion mechanism 4 which prevents sparks formed at the plasma electrode unit 2 from being spread to outside, and a power supply 5 for applying a high voltage to the plasma electrode unit 2.

Hereinafter, each of the components 2 through 5 will be described in detail with reference to the attached drawings.

Figure 3:
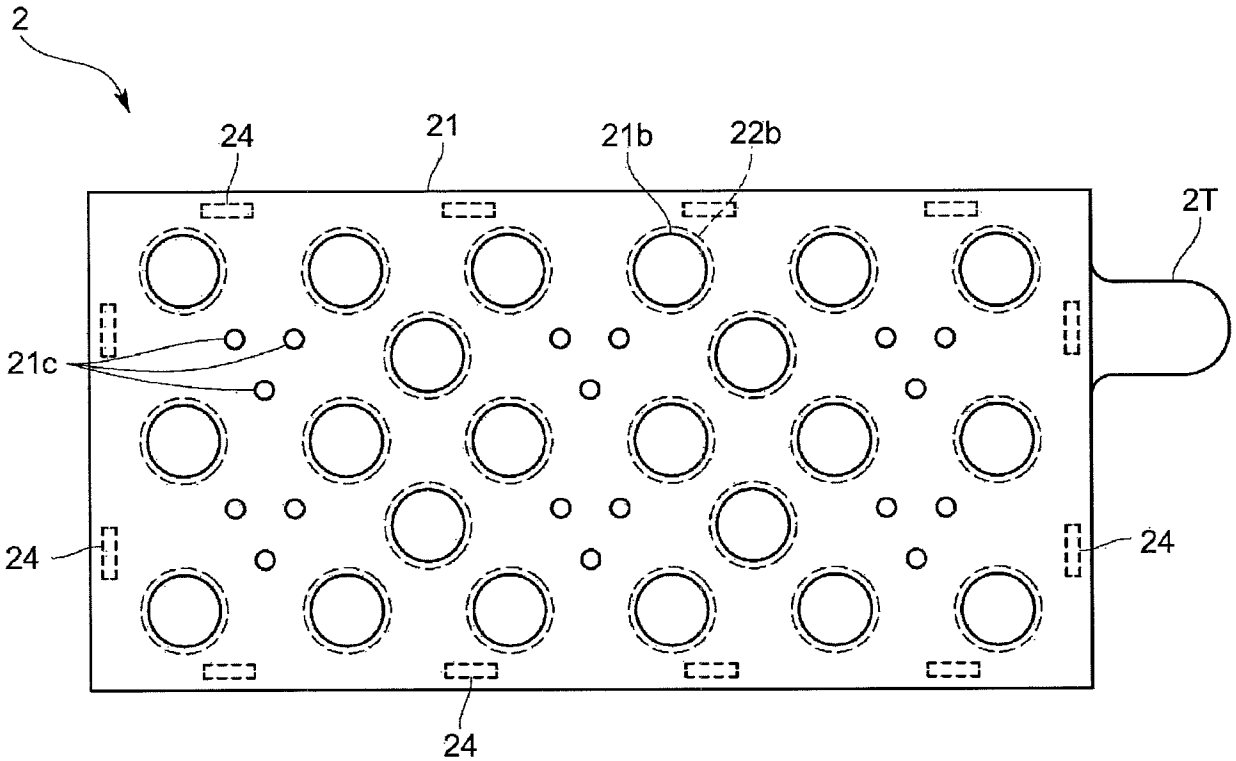
FIG. 3 is a plan view of electrode unit of the plasma generating apparatus.

As shown in FIGS. 2 through 6, the plasma electrode unit 2 includes a pair of electrodes 21 and 22, where dielectric layers 21*a* and 22*a* are respectively formed on surfaces of the electrodes 21 and 22 facing each other, and plasma discharge occurs as a predetermined voltage is applied to the electrodes 21 and 22. Each of the electrodes 21 and 22 is formed to have a substantially rectangular shape when viewed from above particularly as shown in FIG. 3 and is formed of a stainless steel, such as stainless steel SUS403, for example. Furthermore, application terminals 2T to which voltages from the power supply 5 are applied are formed at outer portions of the electrodes 21 and 22 of the plasma electrode unit 2 (refer to FIG. 3).

Figure 6:
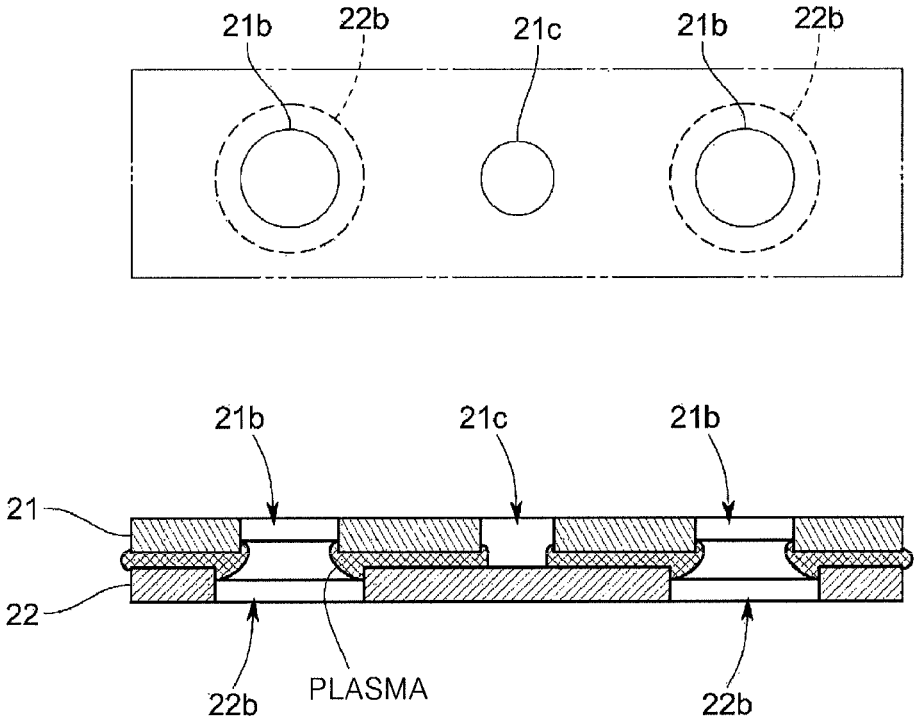
FIG. 6 is a partially-magnified plan view and a sectional view showing a fluid flowing hole and a penetration hole.
Figure 7:
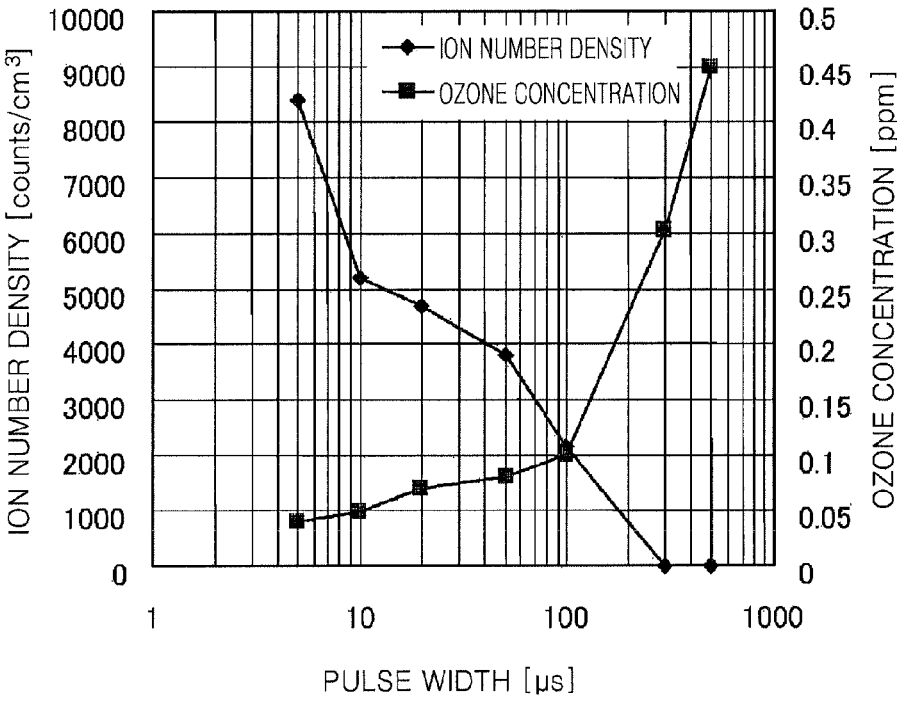
FIG. 7 is a diagram showing pulse-width dependences of ion number densities and ozone concentrations.

Here, the power supply 5 applies voltage to the plasma electrode unit 2 by applying voltages to the electrodes 21 and 22 as pulses with peak values from about 100 V to about 5000 V and pulse widths from about 0.1 μ seconds to about 300 μ seconds. As shown in FIG. 6, when the pulse width is below or equal to 300 μm, ion number density is measured. Furthermore, as ozone concentration decreases, the pulse width also decreases, and thus the number of ions increases and ozone concentration decreases. Therefore, the generated amount of ozone may be suppressed, and active species generated from plasma may be efficiently emitted with little loss via a common filter in the related art. As a result, sterilization of attached germs may be implemented within a short period of time.

Figure 5:
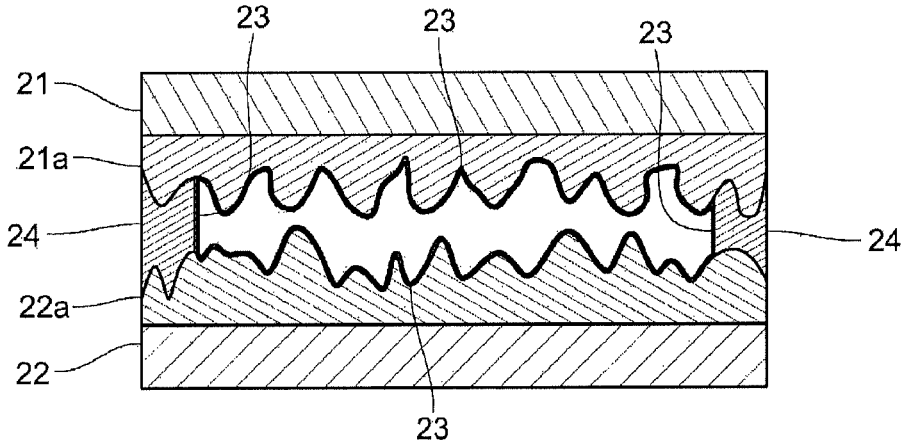
FIG. 5 is a magnified sectional view showing configuration of the electrode unit in closer detail.

Furthermore, as shown in FIG. 5, the dielectric layers 21*a* and 22*a* are formed on surfaces of the electrodes 21 and 22 facing each other by applying a dielectric material, such as barium titanate, on the surfaces of the electrodes 21 and 22 facing each other. Surface roughness (calculated average surface roughness Ra in the present embodiment) of the dielectric layers 21*a* and 22*a* is from about 0.1 μm to about 100 μm. The surface roughness of the dielectric layers 21*a* and 22*a* may alternatively be defined by using the maximum height Ry and 10-point average roughness Rz. Furthermore, the surface roughness of the dielectric layers 21*a* and 22*a* may be controlled by using a thermal spraying method. Furthermore, the dielectric material that is applied onto the surface of the electrodes 21 and 22 may be aluminium oxide, titanium oxide, magnesium oxide, strontium titanate, silicon oxide, silver phosphate, lead zirconate titanate, silicon carbide, indium oxide, cadmium oxide, bismuth oxide, zinc oxide, iron oxide, carbon nanotubes, etc.

Figure 4:
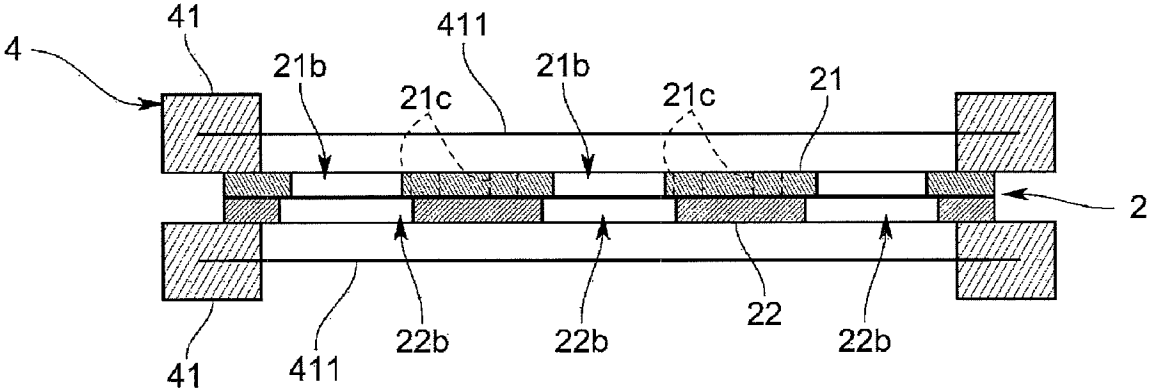
FIG. 4 is a sectional view of the electrode unit and an anti-explosion mechanism.

Furthermore, as shown in FIGS. 3, 4, and 6, fluid flowing holes 21*b* and 22*b* are respectively formed in portions corresponding to each of the electrodes 21 and 22, such that the fluid flowing holes 21*b* and 22*b* communicate with each other and penetrate through the portions and, when the electrodes 21 and 22 are viewed from above, at least portions of outlines of the corresponding fluid flowing holes 21*b* and 22*b* have a different position. In other words, it is configured such that, as viewed from above, the shape of the fluid flowing hole 21*b* formed in the electrode 21 differs from the shape of the fluid flowing hole 22*b* formed in the electrode 22.

In detail, as viewed from above, the shapes of the fluid flowing holes 21*b* and 22*b* that are respectively formed in portions corresponding to the electrodes 21 and 22 are substantially circular (refer to FIGS. 3 and 6), where the size (diameter) of the fluid flowing hole 21*b* formed in the electrode 21 is smaller (e.g., 10 μm or more smaller) than that of the fluid flowing hole 22*b* formed in the electrode 22.

In this regard, as shown in FIGS. 3 and 6, the fluid flowing hole 21*b* formed in the electrode 21 and the fluid flowing hole 22*b* formed in the electrode 22 have concentric circular shapes. Furthermore, in the present embodiment, all of a plurality of fluid flowing holes 21*b* formed in the electrode 21 have the same shape, and all of a plurality of fluid flowing holes 22*b* formed in the electrode 22 also have the same shape, where all of the plurality of fluid flowing holes 21*b* formed in the electrode 21 have a smaller size than all of the plurality of fluid flowing holes 22*b* formed in the electrode 22. Although the fluid flowing holes 21*b* and 22*b* have substantially circular shapes in the present embodiment, the fluid flowing holes 21*b* and 22*b* may have other shapes, as long as at least portions of outlines of corresponding fluid flowing holes 21*b* and 22*b* have a different position when viewed from above.

Furthermore, the total areas of the fluid flowing holes 21*b* and 22*b* respectively formed in the electrodes 21 and 22 are from 2% to 90% of the total areas of the electrodes 21 and 22. In detail, the fluid flowing hole 22*b* formed in the electrode 22 is formed to have a total area from 2% to 90% of the total area of the electrode 22. Furthermore, the fluid flowing hole 21*b* formed in the electrode 21 may be formed to have a total area from 2% to 90% of the total area of the electrode 21.

Furthermore, as shown in FIGS. 3 and 6, in the plasma electrode unit 2 according to the present embodiment, a penetration hole 21*c* is formed in the electrode 21 separately from the fluid flowing holes 21*b* and 22*b*, and the penetration hole 21*c* is blocked by the electrode 22. Furthermore, the fluid flowing holes 21*b* and 22*b* formed in the electrodes 21 and 22 are both referred to as a completely opened portion, whereas an opening of the penetration 21*c* is referred to as semi-opened portion.

The penetration hole 21*c* has an opening size that is 10 μm or more smaller than that of the fluid flowing hole 21*b*. The penetration hole 21*c* is formed by substituting a part of the fluid flowing holes 21*b* that are regularly formed, and the penetration hole 21*c* is formed around the fluid flowing hole 21*b* (refer to FIG. 3).

An air-blowing mechanism 3 is arranged at a side of the electrode 22 of the plasma electrode unit 2 and includes an air-blowing fan for forcibly blowing air toward the fluid flowing holes 21*b* and 22 (the completely-opened portion) of the plasma electrode unit 2. In detail, air blown by the air-blowing mechanism 3 passes through the fluid flowing holes 21*b* and 22*b* at a velocity from about 0.1 m/s to about 30 m/s.

As shown in FIG. 4, the anti-explosion mechanism 4 includes a protective cover 41 arranged outside of the pair of electrodes 21 and 22 to prevent sparks, which are generated as inflammable gas flows into the fluid flowing holes 21*b* and 22*b* and is ignited by plasma, from being propagated to outside. In detail, the anti-explosion mechanism 4 includes a metal mesh 411, wherein the protective cover 41 is arranged outside the pair of electrodes 21 and 22, a diameter of the metal mesh 411 is 1.5 mm or smaller, and the opening ratio of the metal mesh 411 is 30% or higher.

However, in the present embodiment, as shown in FIG. 5, single-layer coating films 23 are formed on surfaces of the dielectric layers 21*a* and 22*a* of the electrodes 21 and 22.

The coating films 23 are water-repellent and are formed of glass, fluororesin, silicon, diamond-like carbon (DLC), fluorine-containing DLC, $SiO_2$, $ZrO_2$, $TiO_2$, $SrO_2$, MgO, or a combination thereof. Furthermore, the coating films 23 are formed using a thin-film forming method, such as deposition, chemical vapor deposition (CVD), sputtering, or ion plating, a plating method, a thermal spraying method, a spray coating method, a spin coating method, or an application method to uniformly form the coating films 23 on the surfaces of the dielectric layers 21*a* and 22*a*.

Figure 8:
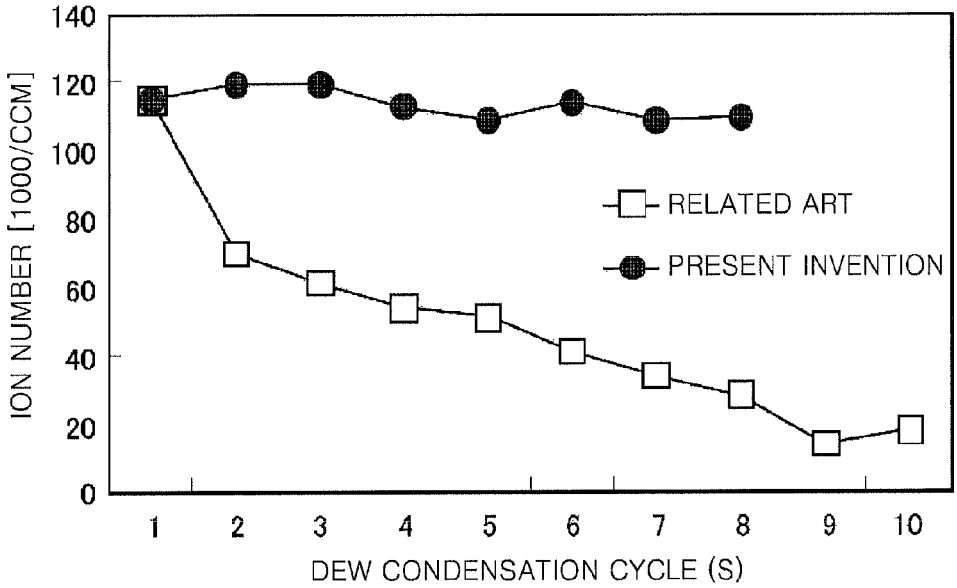
FIG. 8 is a diagram showing relationships between dew formation cycles and ion number densities in the prior art and in the present invention.

Relationships between dew condensation cycles and ion number densities in the plasma generating apparatus 100 (the present invention) in which the coating films 23 are formed and a plasma generating apparatus (related art) in which no coating film is formed are shown in FIG. 8. In FIG. 8, ion number density gradually decreases from the second dew condensation cycle in a plasma generating apparatus according to the related art, whereas ion number density does not decrease regardless of dew condensation cycles in the plasma generating apparatus 100 according to the present invention.

A gap having a predetermined width is formed between the electrodes 21 and 22 due to spacers 24 that are formed of an insulation material. The spacers 24 are formed at various locations on edge portion of the electrodes 21 and 22, as shown in FIG. 3. Furthermore, the locations of the spacers 24 are not limited to those shown in FIG. 3. For example, the spacers 24 may be arranged throughout the edge portions of the electrodes 21 and 22 or arbitrary locations, such as center portions of the electrodes 21 and 22, as long as the fluid flowing holes 21*b* and 22*b* and the penetration hole 21*c* are not blocked. The spacer 24 may have a thickness below or equal to 500 μm. If the thickness of the spacer 24 is greater than 500 μm, a voltage for generating plasma increases, and thus ozone may be easily generated. Furthermore, the spacer 24 is formed of fluororesin, epoxy, polyimide, alumina, glass, or a combination thereof. Like the dielectric layers 21*a* and 22*a*, the spacers 24 according to the present embodiment are formed using a thermal spraying method. In detail, raw material units of the spacers 24 are formed on each of the dielectric layers 21*a* and 22*a* of the electrodes 21 and 22 to have a thickness below or equal to 250 μm, for example, and the spacers 24 having a thickness below or equal to 500 μm are formed by combining the raw material units. Alternatively, the spacers 24 may be formed on the dielectric layer 21*a* (or the dielectric layer 22*a*) of the electrode 21 (or the electrode 22).

The coating film 23 according to the present embodiment is formed after the dielectric layers 21*a* and 22*a* are formed using a thermal spraying method and the raw material units of the spacers 24 are formed on the dielectric layers 21*a* and 22*a* by using a thermal spraying method. Therefore, the spacers 24 are covered by the coating film 23, and thus dew condensation and moisture attachment to the spacers 24 may be prevented. Alternatively, the spacers 24 may be formed after the dielectric layers 21*a* and 22*a* and the coating film 23 are formed.

Figure 9:
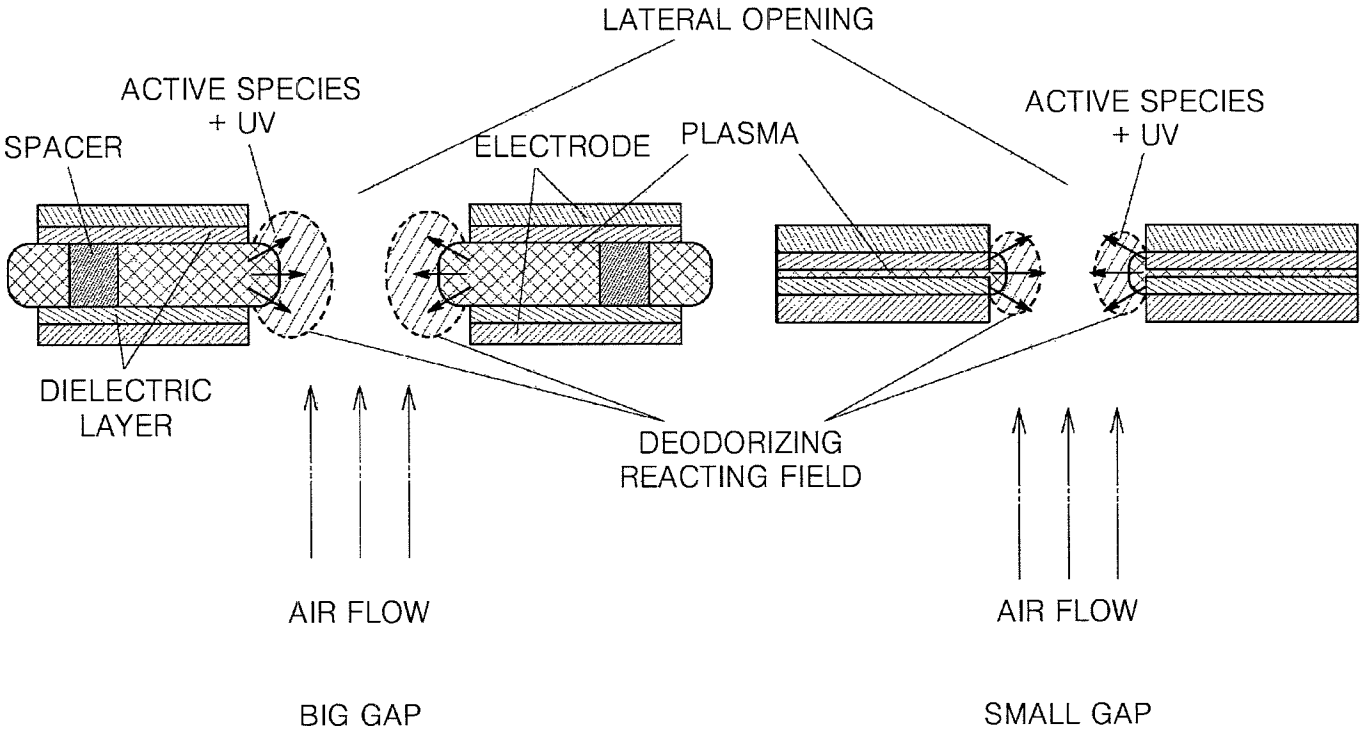
FIG. 9 is a concept view showing deodorizing efficiencies according to distances between electrodes.
Figure 10:
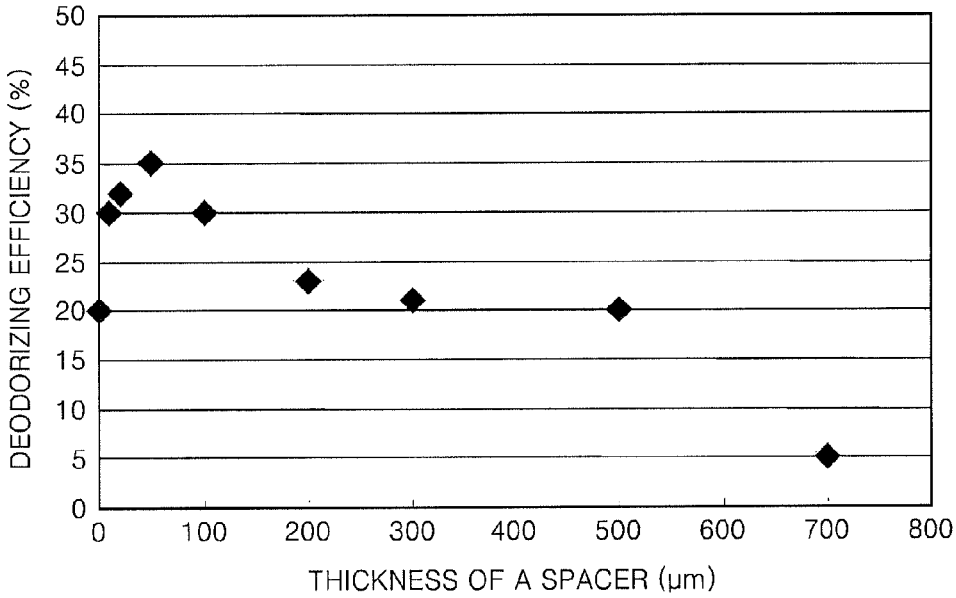
FIG. 10 is a diagram showing dependency of deodorizing efficiency on thickness of a spacer.

As the spacers 24 are arranged as described above, a distance between the electrodes 21 and 22 may be set as large as the thickness of the spacers 24. Therefore, as shown in FIG. 9, a deodorizing reacting field becomes larger, and the volume by which air and plasma contact each other increases. As a result, deodorizing efficiency increases. Here, the dependency of the deodorizing efficiency on the thickness of the spacers 24 is shown in FIG. 10. Compared to deodorizing efficiency in a case in which no spacer 24 is arranged is 20%, the deodorizing efficiency in a case in which the spacers 24 have a thickness of 10 μm is 30%, the deodorizing efficiency in a case in which the spacers 24 have a thickness of 20 μ, is 32%, and the deodorizing efficiency in a case in which the spacers 24 have a thickness of 50 μm is up to 35%. Furthermore, the deodorizing efficiency in a case in which the spacers 24 have a thickness of 100 μm is 30%. Here, the deodorizing efficiency increases remarkably as the thickness of the spacers 24 increases from 10 μm to 100 μm. Furthermore, although the deodorizing efficiency decreases when the thickness of the spacers 24 is greater than 100 μm, the deodorizing efficiency is still 20% or higher as long as the thickness of the spacers 24 is less than or equal to 500 μm. However, if the thickness of the spacers 24 exceeds 500 μm, the deodorizing efficiency becomes worse than that of the case in which the spacers 24 are not arranged.

Figure 11:
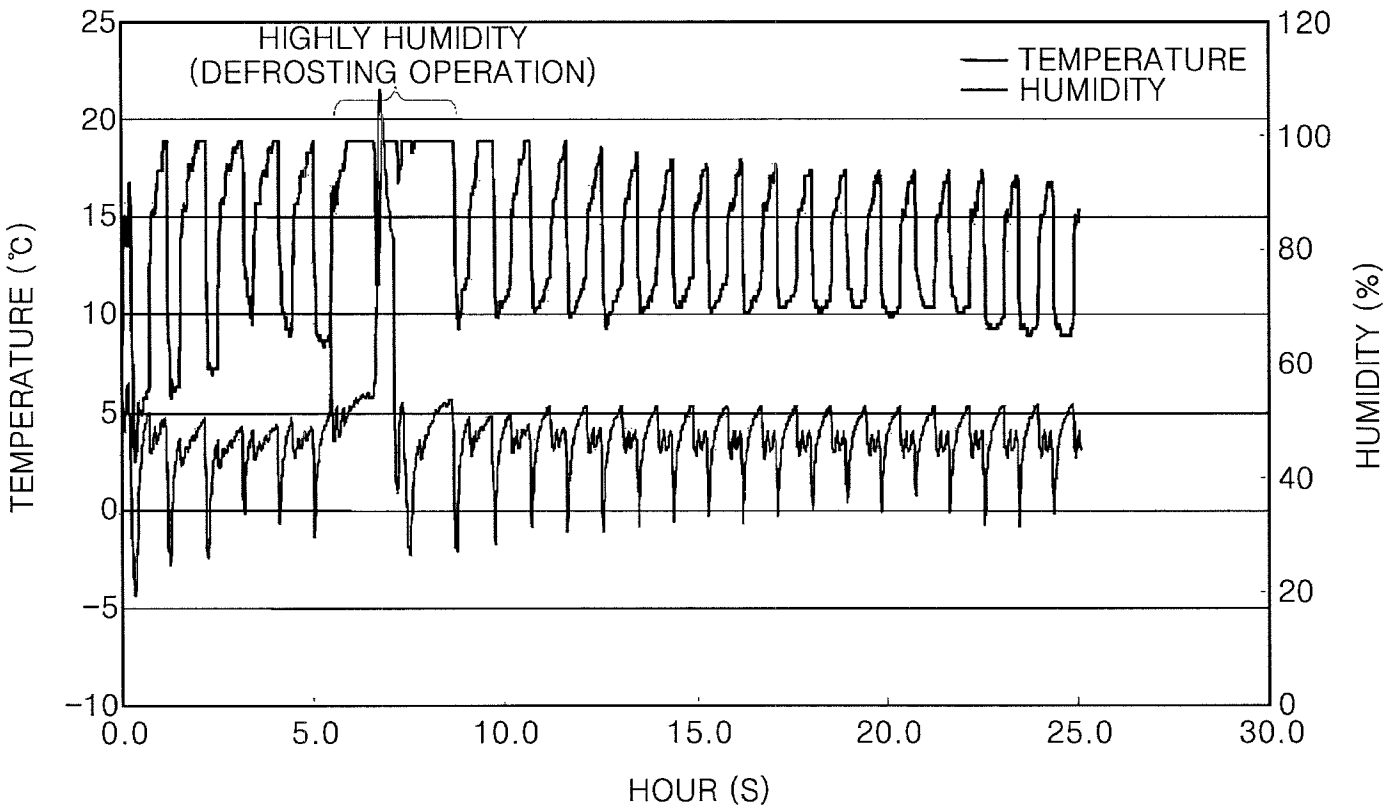
FIG. 11 is a diagram showing an example of humidity changes inside a refrigerator.

The plasma generating apparatus 100 configured as described above may be preferably used in a storage space of a refrigerator. As shown in FIG. 11, the storage space of a refrigerator becomes highly humid during a defrosting operation, and thus dew condensation or moisture attachment may easily occur between the electrodes 21 and 22. On the contrary, in the plasma generating apparatus 100 according to the present embodiment, the water-repellent coating film 23 is arranged on the surfaces of the dielectric layers 21*a* and 22*a* of the electrodes 21 and 22, and thus dew condensation or moisture attachment hardly occur. Furthermore, since the spacers 24 form a sufficient distance between the electrodes 21 and 22, even if dew condenses, water from the dew is easily drained to outside of the electrodes 21 and 22.

In the plasma generating apparatus 100 according to the embodiment as described above, the amount of plasma generated at the corresponding fluid flowing holes 21*b* and 22*b* may be maximized, and thus the area by which the plasma and fluid contact each other may be maximized. Therefore, the generated amount of active species (ions and radicals) may be increased, and the effects of deodorizing by using the active species and sterilizing floating germs and attached germs by emitting the active species to outside of the plasma generating apparatus 100 may be sufficiently high. Furthermore, since the water-repellent coating film 23 is arranged on the surfaces of the dielectric layers 21*a* and 22*a*, dew condensation and moisture attachment hardly occur on the dielectric layers 21*a* and 22*a*. For example, the deterioration of sterilizing efficiency under high humidity inside a refrigerator may be prevented, and thus sterilizing efficiency may be maintained for an extended period of time.

Figure 12:
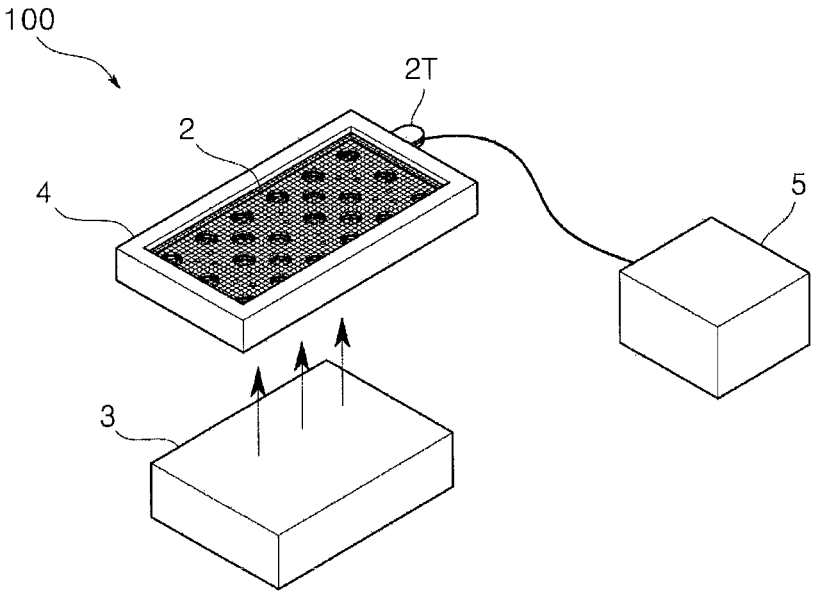
FIG. 12 is a perspective view of a plasma generating apparatus according to another embodiment of the present invention.
Figure 13:
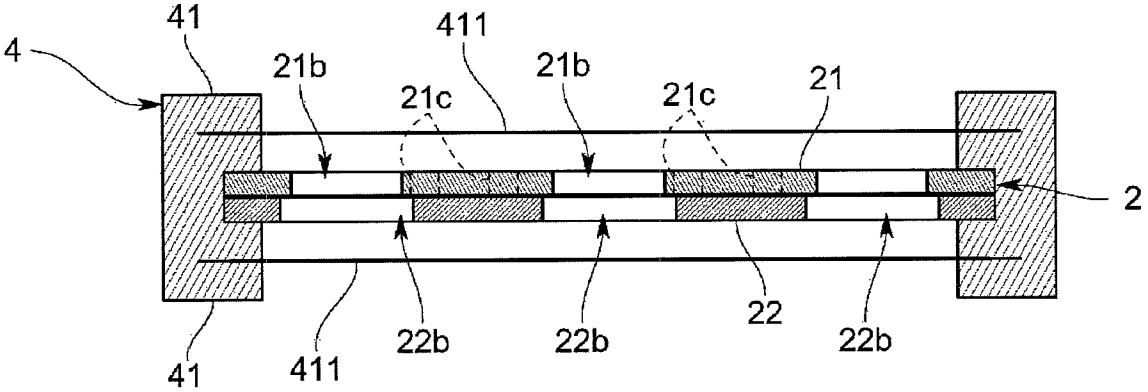
FIG. 13 is a sectional view of an electrode unit and an anti-explosion mechanism of the plasma generating apparatus of FIG. 12.

FIG. 12 is a perspective view of a plasma generating apparatus 100 according to another embodiment of the present invention and FIG. 13 is a sectional-view showing an electrode unit and an anti-explosion mechanism of the plasma generating apparatus 100 of FIG. 12.

Figure 14:
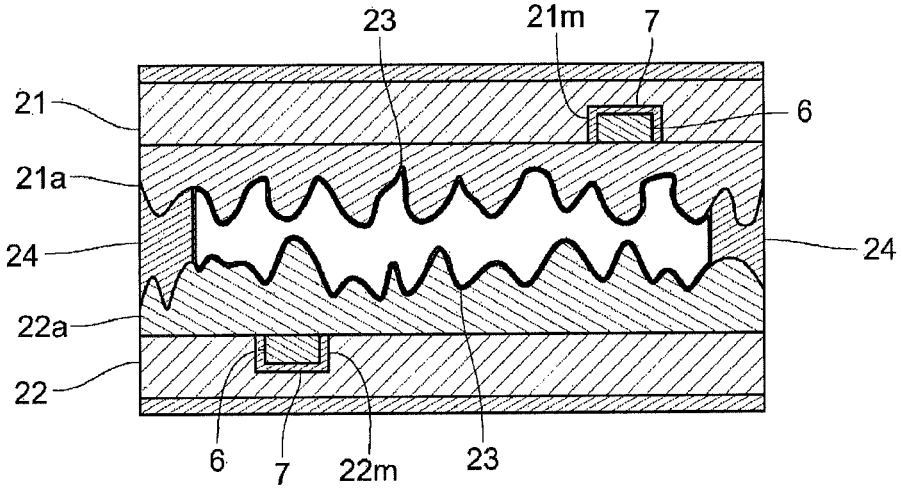
FIG. 14 is a magnified sectional view showing a surface faced by the electrode unit of the plasma generating apparatus of FIG. 12.

The plasma generating apparatus 100 according to the present embodiment is substantially the same as the plasma generating apparatus 100 according to the previous embodiment of FIG. 1, except that, as shown in FIG. 14, heating elements 6 are buried in the electrodes 21 and 22.

Here, detailed descriptions of the plasma electrode unit 2, the air-blowing mechanism 3, the anti-explosion mechanism 4, the power supply 5, and the coating film 23 are same as those of the previous embodiment and thus are omitted.

Figure 15:
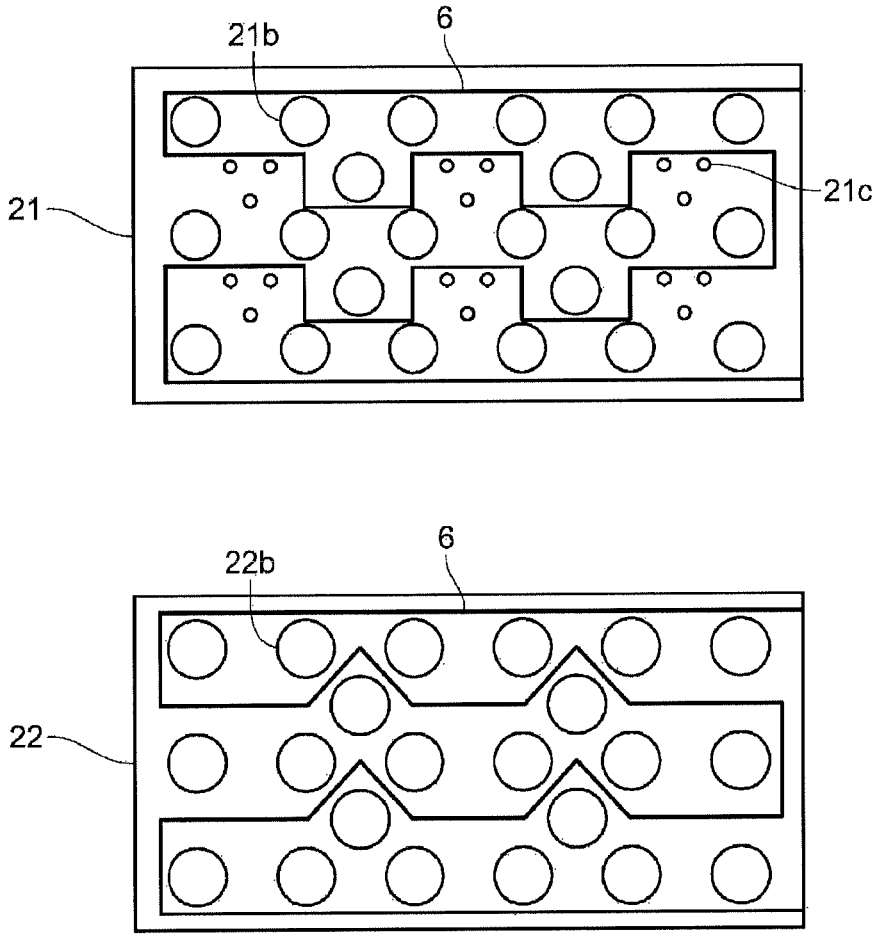
FIG. 15 is a plan view of an example of heating element forming patterns.

The heating elements 6 heat the electrodes 21 and 22 and the dielectric layers 21*a* and 22*a* by using resistance heating, as shown in FIGS. 14 and 15, are arranged in a concave portion 21*m* formed in portions of the electrode 21, except in portions corresponding to the fluid flowing hole 21*b* and the penetration hole 21*c*, and are arranged in a concave portion 22*m* formed in portions of the electrode 22, except in portions corresponding to the fluid flowing hole 22*b* and the penetration hole 22*c*. Furthermore, the heating elements 6 are accommodated in the concave portions 21*m* and 22*m* and are electrically insulated from the electrodes 21 and 22 by insulators 7. In detail, the heating element 6 is formed of a heat emitting resistor, such as Ni—Cr-based heat emitter, molybdenum disilicide heat emitter, silicon carbide heat emitter, or graphite heat emitter, a varistor device, an infrared LED, or a combination thereof. The heating element 6 emits heat as power is supplied from an external power source, such as the power supply 5. Furthermore, the heating element 6 may emit heat corresponding to a heating temperature below or equal to 150° C.

The plasma generating apparatus 100 configured as described above may be preferably used in the storage space of a refrigerator. As shown in FIG. 11, the storage space of a refrigerator becomes highly humid during a defrosting operation, and thus dew condensation or moisture attachment may easily occur between the electrodes 21 and 22. On the contrary, in the plasma generating apparatus 100 according to the present embodiment, the heating elements 6 are arranged in the electrodes 21 and 22 and heat the electrodes 21 and 22 and the dielectric layers 21*a* and 22*a*, and thus dew condensation and moisture attachment hardly occur and, even if dew condenses or moisture is attached, the dew or moisture may be dried. Furthermore, since the water-repellent coating film 23 is arranged on the surfaces of the dielectric layers 21*a* and 22*a* and the spacers 24 form a sufficient distance between the electrodes 21 and 22, dew or moisture may be dried faster, and thus the deterioration of sterilizing efficiency and deodorizing efficiency may be reduced. The heating elements 6 may operate at an optimal temperature by detecting the temperature and humidity inside a refrigerator. Alternatively, the temperature of the heating elements 6 may be adjusted or the heating elements 6 may be turned on/off in linkage to operations of a compressor or defrosting heater of a refrigerator. Furthermore, operation of the heating elements 6 may be controlled by detecting the operating state of the plasma generating apparatus 100. For example, if voltages applied to the electrodes 21 and 22 are detected and the voltages tend to decrease (that is, if the intensity of plasma is weakened), the temperature of the heating elements 6 may be raised.

In the plasma generating apparatus 100 according to the other embodiment as described above, the amount of plasma generated at the corresponding fluid flowing holes 21*b* and 22*b* may be maximized, and thus the area by which the plasma and fluid contact each other may be maximized. Therefore, the generated amount of active species (ions and radicals) may be increased, and the effects of deodorizing by using the active species and sterilizing floating germs and attached germs by emitting the active species to outside of the plasma generating apparatus 100 may be sufficiently high. Furthermore, since the heating elements 6 are arranged in the electrodes 21 and 22 and heat the electrodes 21 and 22 and the dielectric layers 21*a* and 22*a*, dew condensation and moisture attachment hardly occur at the dielectric layers 21*a* and 22*a*, and, even if dew condenses or moisture is attached, the dew or moisture may be removed. For example, the deterioration of sterilizing efficiency under high humidity inside a refrigerator may be prevented, and thus sterilizing efficiency may be maintained for an extended period of time. Even if plasma generation efficiency is deteriorated due to dew condensation on surface of the dielectric layers 21*a* and 22*a*, the dielectric layers 21*a* and 22*a* may be dried as the heating elements 6 emit heat, and thus plasma generation may be restored. Furthermore, since the heating elements 6 are arranged in the electrodes 21 and 22 and directly heat the electrodes 21 and 22, the period of time for heating the dielectric layers 21*a* and 22*a* and energy for heating the dielectric layers 21*a* and 22*a* may be reduced.

Alternatively, according to another embodiment, deodorizing efficiency may be improved by forcing dew condensation. In other words, malodor compounds (e.g., water-soluble malodor compounds, such as trimethylamine) are absorbed and condensed in moisture of initially-condensed dew, and then the electrodes 21 and 22 are heated to generate high voltage plasma. Therefore, malodor compounds may be decomposed at a high efficiency.

Figure 16:
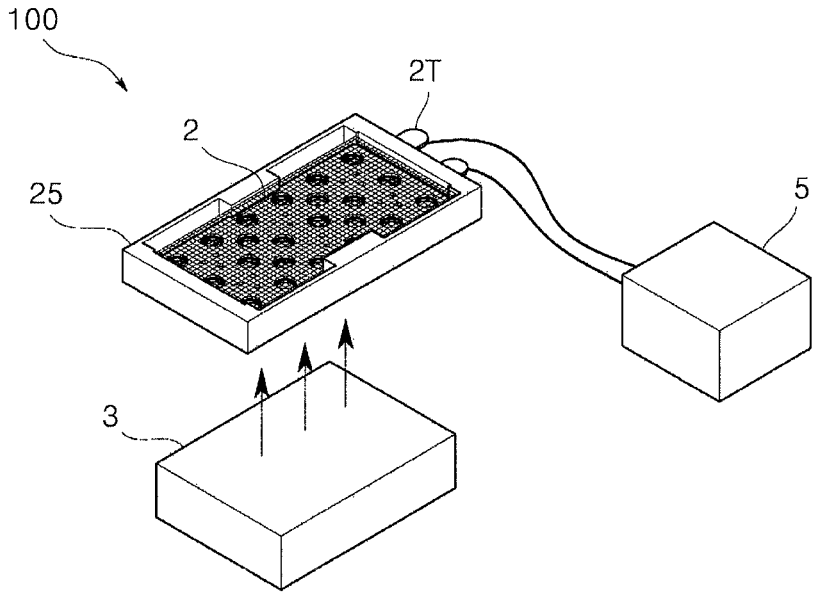
FIG. 16 is a perspective view of a plasma generating apparatus according to another embodiment of the present invention.
Figure 17:
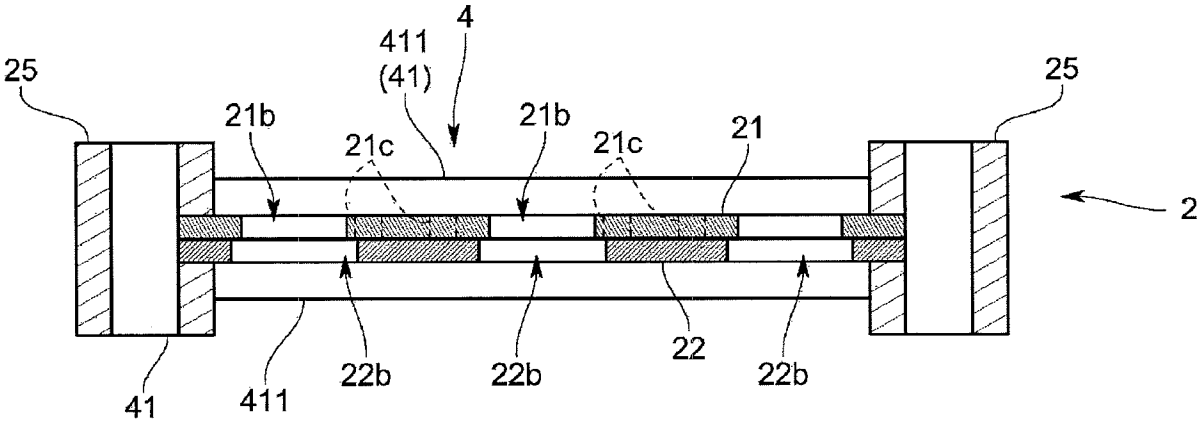
FIG. 17 is a sectional view of an electrode unit and an anti-explosion mechanism of the plasma generating apparatus of FIG. 16.

FIG. 16 is a perspective view of a plasma generating apparatus 100 according to another embodiment and FIG. 17 is a sectional-view showing a plasma electrode unit 2 and an anti-explosion mechanism 4 of the plasma generating apparatus 100 of FIG. 16.

Figure 18:
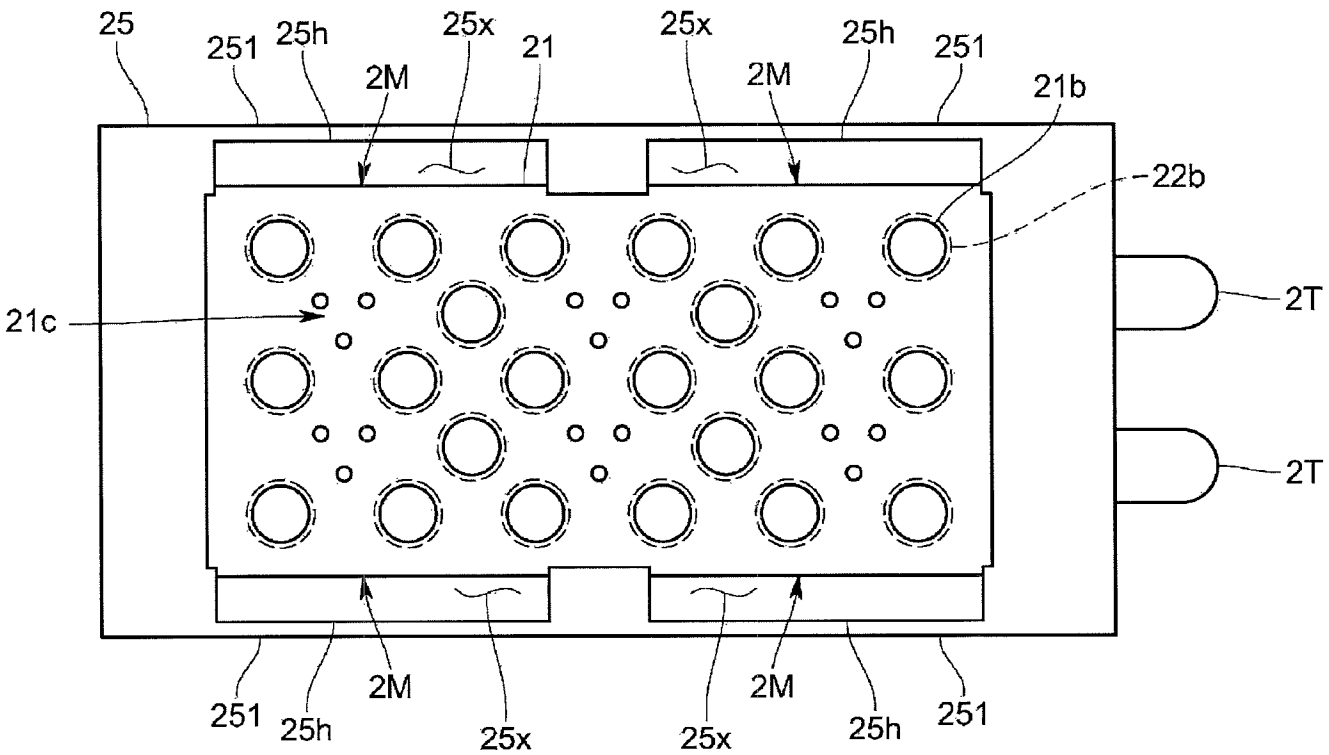
FIG. 18 is a plan view of a plasma electrode unit of the plasma generating apparatus of FIG. 16.

The plasma generating apparatus 100 according to the present embodiment is substantially the same as the plasma generating apparatus 100 according to the previous embodiment of FIG. 11., except that, as shown in FIG. 18, a casing 25 supporting the pair of electrodes 21 and 22 has substantially the shape of a rectangular rim, where a lateral opening 2M formed between the pair of the electrodes 21 and 22 is partially opened in a lengthwise sidewall of the casing. Furthermore, the anti-explosion mechanism 4 is not shown in FIGS. 18 and 19.

A detailed descriptions of the plasma electrode unit 2, the air-blowing mechanism 3, the anti-explosion mechanism 4, the power supply 5, and the coating film 23 are same as of the previous embodiment and thus are omitted.

The protective cover 41, which is one of the components of the anti-explosion mechanism 4, may be detachably attached to the top surface and the bottom surface of the casing 25.

Figure 19:
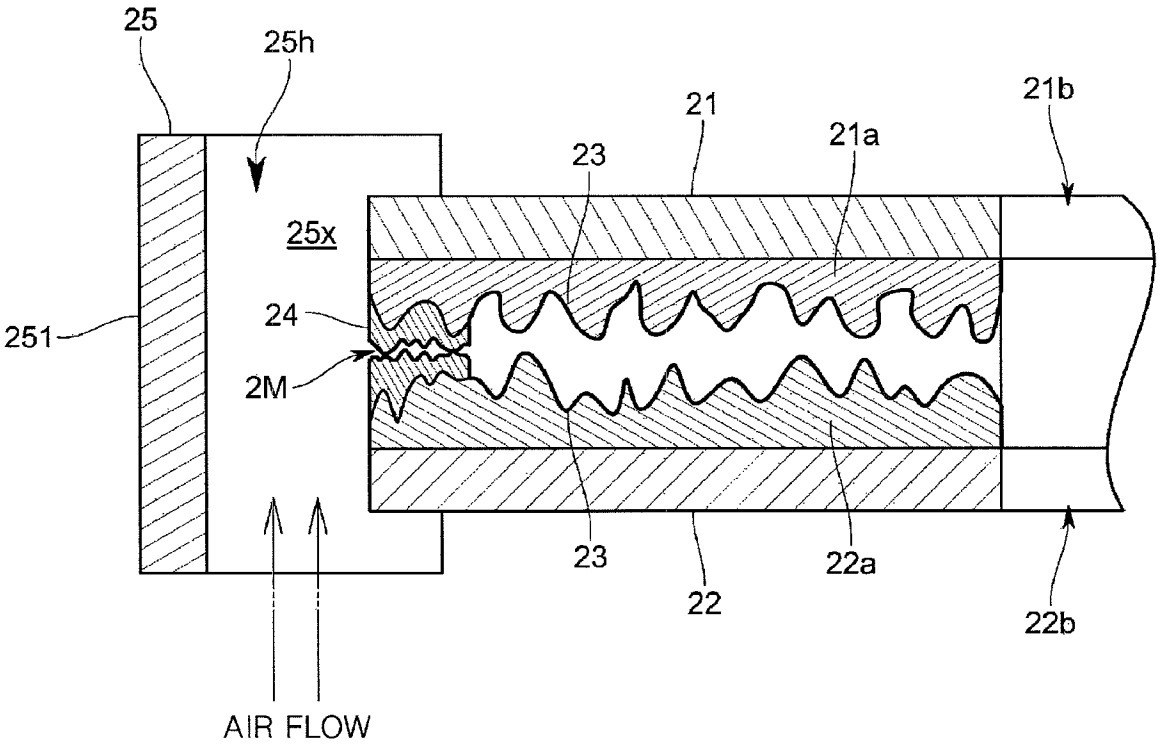
FIG. 19 is a magnified sectional view showing configuration of a casing of the plasma generating apparatus of FIG. 16.

Furthermore, the casing 25 includes a wall unit 251 facing the lateral opening 2M, as shown in FIGS. 18 and 19, and the wall unit 251 forms a gas flow path 25*x* having a vertically-arranged inlet and outlet between the wall unit 251 and the lateral opening 2M.

In detail, penetration holes 25*h* is formed in two lengthwise sidewalls of the casing 25 penetrate the casing 25 from the top surface to the bottom surface, and form the gas flow path 25*x*. Furthermore, the wall unit 251 facing the lateral opening 2M is formed by sidewalls of the penetration holes 25*h*. As shown in FIG. 18, the penetration hole 25*h* is a straight linear hole extending in the lengthwise direction. In the present embodiment, two penetration holes 25*h* are formed in the lengthwise direction in each sidewall of the casing 25. Furthermore, wind (air flow) generated by the air-blowing mechanism 3 flows into the gas flow path 25*x* formed by the penetration holes 25*h*. Therefore, wind flows in the opened lateral opening 2M, and thus dew water formed between the pair of electrodes 21 and 22 may be dried faster. Furthermore the shape and number of penetration holes 25*h* are not limited to those stated above and may vary.

The plasma generating apparatus 100 configured as described above may be preferably used in the storage space of a refrigerator. As shown in FIG. 11, the storage space of a refrigerator becomes highly humid during a defrosting operation, and thus dew condensation or moisture attachment may easily occur between the electrodes 21 and 22. On the contrary, in the plasma generating apparatus 100 according to the present embodiment, since the water-repellent coating film 23 is arranged on the surfaces of the dielectric layers 21*a* and 22*a*, dew condensation and moisture attachment hardly occur on the dielectric layers 21*a* and 22*a*. Furthermore, since the lateral openings 2M are opened by sidewalls of the casing 25, even in a case of dew condensation, dew may be dried. Furthermore, since the spacers 24 form a sufficient distance between the electrodes 21 and 22, even if dew condenses, water from the dew is easily drained to outside of the electrodes 21 and 22.

Confirming the drying efficiency of a plasma generating apparatus according to the present embodiment, the plasma generating apparatus was installed inside a refrigerator and the number of ions was measured. As experimental examples, a plasma generating apparatus (No. 1) in which lateral openings are not opened and a coating film and spacers are not formed, a plasma generating apparatus (No. 2) in which lateral openings are opened by the above-described penetration holes and a coating film and spacers are not formed, a plasma generating apparatus (No. 3) in which lateral openings are not opened and a coating film and spacers are formed, and a plasma generating apparatus (No. 4) in which lateral openings are opened by the above-described penetration holes and a coating film and spacers are formed were prepared. A result of measuring the number of ions of the plasma generating apparatuses (No. 1 through 4) is shown in Table 1 below.

TABLE 1

| | Opening | | | Operation in Refrigerator (Days) | | | | |
|---|---|---|---|---|---|---|---|---|
| No. | lateral Openings | Coating film | Spacers | 0 | 1 | 3 | 7 | 30 |
| | | | | Number of lons(10,000/cm$^3$) | | | | |
| 1 | X | X | X | 10 | 5 | 0.3 | 0.2 | 0.1 |
| 2 | ○ | X | X | 10 | 8 | 7 | 7 | 7 |
| 3 | X | ○ | ○ | 10 | 5 | 4 | 3 | 2 |
| 4 | ○ | ○ | ○ | 10 | 10 | 10 | 10 | 10 |

From the result of the experiments shown in Table 1, it is clear that, if lateral openings are not opened in a pair of electrodes, the number of ions remarkably decreased as the days of operation in a refrigerator increased even if a coating film and spacers were formed (experimental examples No.1 and No. 3). On the contrary, as it is clear with the experimental example No. 2, the initial decrease in the number of ions due to dew condensation may be minimized by opening lateral openings. Furthermore, as it is clear with the experimental example No. 4, if opening lateral openings are combined with a coating film and spacers, the decrease in the number of ions may be prevented more effectively, and thus the plasma generating apparatus of the experimental example No. 4 may be stably used even in an environment like a refrigerator, in which humidity varies significantly and dew condensation may easily occur between a pair of electrodes.

In the plasma generating apparatus 100 according to an embodiment as described above, the amount of plasma generated at the corresponding fluid flowing holes 21*b* and 22*b* may be maximized, and thus the area by which the plasma and fluid contact each other may be maximized. Therefore, the generated amount of active species (ions and radicals) may be increased, and the effects of deodorizing by using the active species and sterilizing floating germs and attached germs by emitting the active species to outside of the plasma generating apparatus 100 may be sufficiently high. Furthermore, since the lateral openings 2M formed between the pair of electrodes 21 and 22 are at least partially opened by the casing 25, dew water formed in the pair of electrodes 21 and 22 may be easily evaporated, and thus cumulative condensation of dew water in the pair of electrodes 21 and 22 may be prevented. Therefore, the drying efficiency of the dielectric layers 21*a* and 22*a* may be improved. As a result, generation of plasma may be stabilized, and thus the generated amount of active species may be stabilized.

Furthermore, the present invention is not limited to the above embodiments.

For example, although a coating film is arranged on a dielectric layer of each electrode in the above embodiments, it is still effective even if a coating film is arranged on a dielectric layer of only one of the electrodes.

Figure 20:
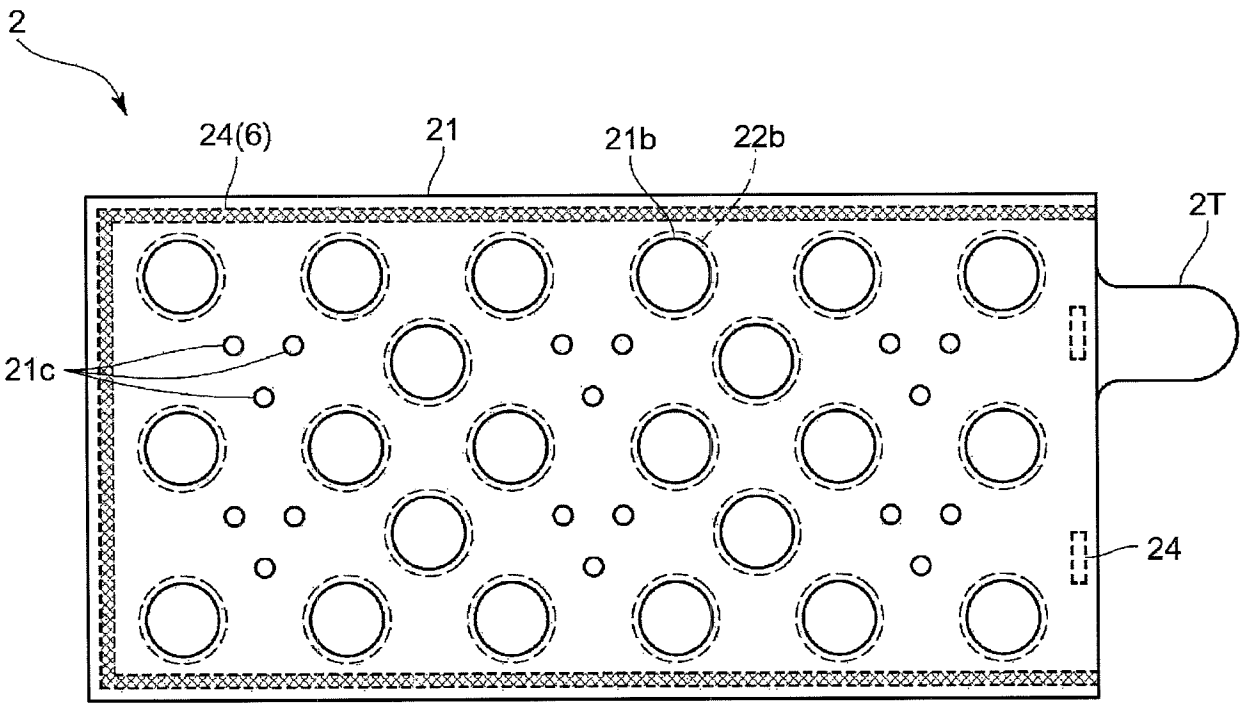
FIG. 20 is a sectional view showing configuration of an electrode unit of a plasma generating apparatus according to an embodiment modified from the embodiment shown in FIG. 12.

According to another embodiment, the locations of heating elements are not limited to inside the electrodes, as in the above embodiments. For example, as shown in FIG. 20, the spacers 24 arranged on surfaces of the dielectric layers 21*a* and 22*a* may be formed with heating elements. In this case, since the spacers 24 and the heating elements are integrated with each other, the configuration of electrodes may be simplified and the evaporation of moisture due to heating of the electrodes 21 and 22 may be accelerated.

Figure 21:
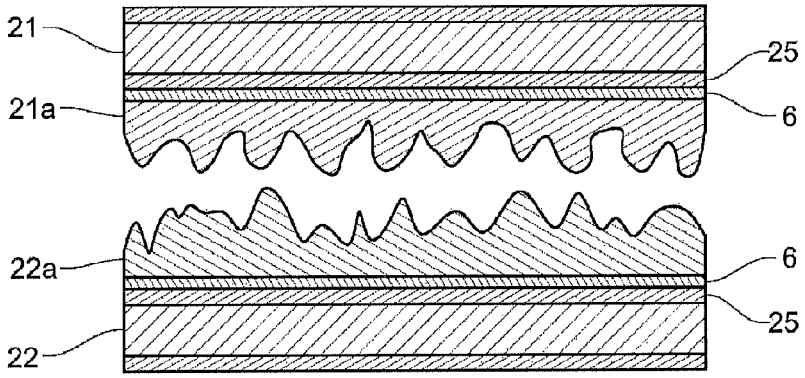
FIG. 21 is a sectional view showing configuration of an electrode unit of a plasma generating apparatus according to an embodiment modified from the embodiment shown in FIG. 12.

As shown in FIG. 21, an insulation layer 25 may be formed on a stainless steel plate constituting the electrodes 21 and 22, the heating elements 6 may be formed on the insulation layer 25, and the dielectric layers 21*a* and 22*a* may be formed on the heating elements 6. In other words, the heating elements 6 may be arranged between the electrodes 21 and 22 and the dielectric layers 21*a* and 22*a*. In this case, it is not necessary to process the electrodes 21 and 22 to install the heating elements 6 therein.

The heating elements may be arranged on portions of surfaces of the dielectric layers 21*a* and 22*a*, such that a sufficient amount of plasma can be generated.

Figure 22:
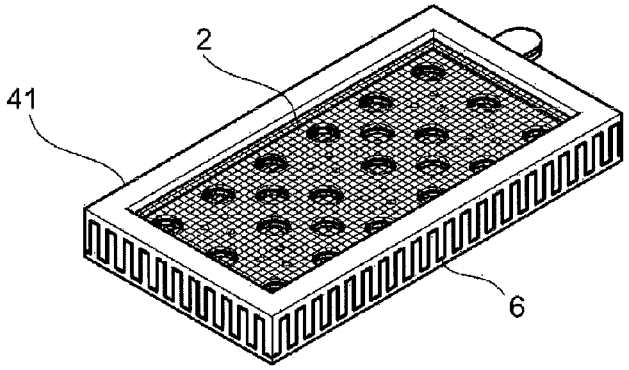
FIG. 22 is a perspective view showing configuration of an electrode unit of a plasma generating apparatus according to an embodiment modified from the embodiment shown in FIG. 12.

As shown in FIG. 22, the heating elements 6 may be arranged on a surface of or inside a casing (the protective cover 41 in the above embodiments), which supports the pair of electrodes 21 and 22 of the plasma electrode unit 2, to heat the electrodes 21 and 22 and the dielectric layers 21*a* and 22*a*. In this case, the plasma generation apparatus 100 may have simpler configuration than the configuration in which the heating elements 6 are arranged at the electrodes 21 and 22 or the dielectric layers 21*a* and 22*a*, and thus the plasma generation apparatus 100 may be easily manufactured.

Figure 23:
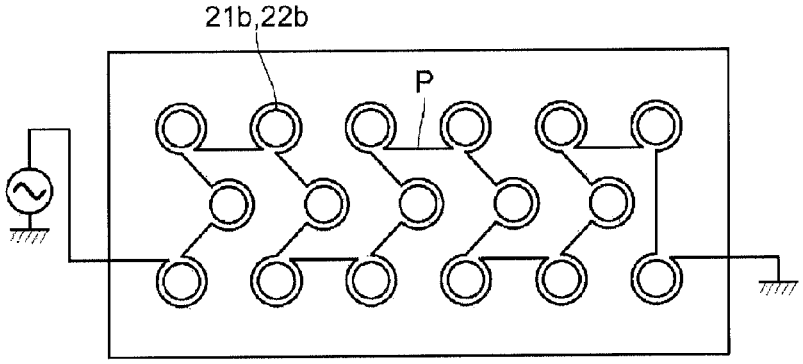
FIG. 23 is a plan view showing configuration of an electrode unit of a plasma generating apparatus according to an embodiment modified from the embodiment shown in FIG. 12.

As shown in FIG. 23, the dielectric layers 21*a* and 22*b* may be heated by induction-heating the electrodes 21 and 22 by forming conductive film patterns P on surfaces of or inside the electrodes 21 and 22 and applying high-frequency voltages to the conductive film patterns P.

Figure 24:
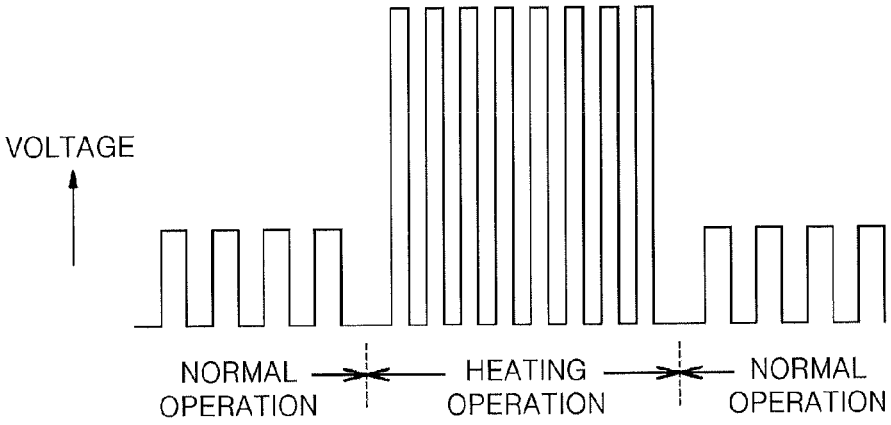
FIG. 24 is a diagram showing a voltage applying pattern according to an embodiment modified from the embodiment shown in FIG. 12.
Figure 25:
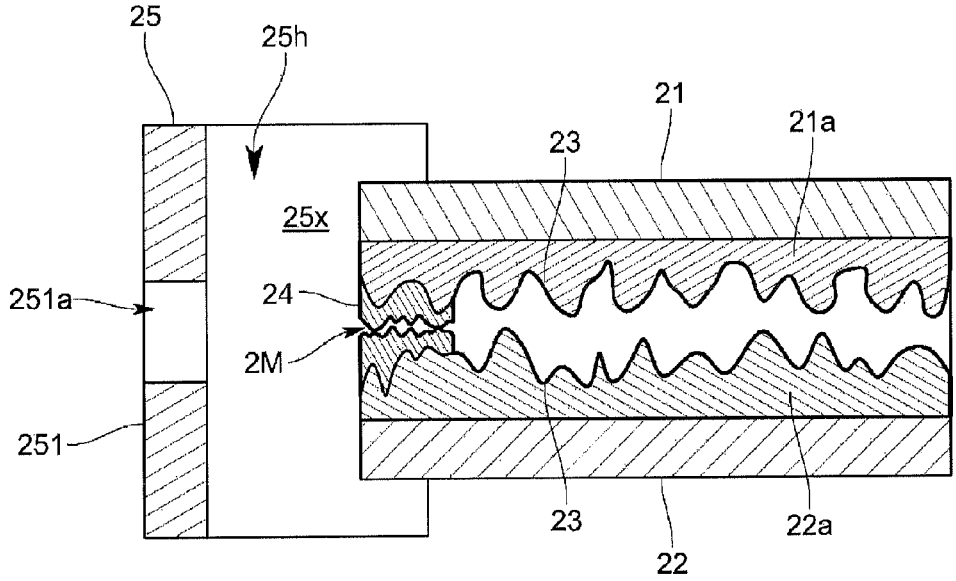
FIG. 25 is a magnified sectional view showing configuration of a casing of a plasma generating apparatus according to an embodiment modified from the embodiment shown in FIG. 16.

As shown in FIG. 24, during the heating operation, pulse voltages greater than pulse voltages applied to the pair of electrodes 21 and 22 during normal operation may be applied to the pair of electrodes 21 and 22, so that plasma is generated and the dielectric layers 21 a and 22*a* are heated thereby. In this case, the generated amount of ozone increases, and thus it is necessary to arrange a catalyst for decomposing generated ozone or to take any measures equivalent thereto.

Furthermore, in the casing 25 according to the above embodiment, aside from the gas flow path 25*x* having a vertically-arranged inlet and outlet, a gas flow path may be formed by forming a penetration hole 251*a* in the wall unit 251 facing the lateral opening 2M. In this case, the propagation of sparks may be prevented and a significant amount of air may be blown via the lateral opening 2M.

Figure 26:
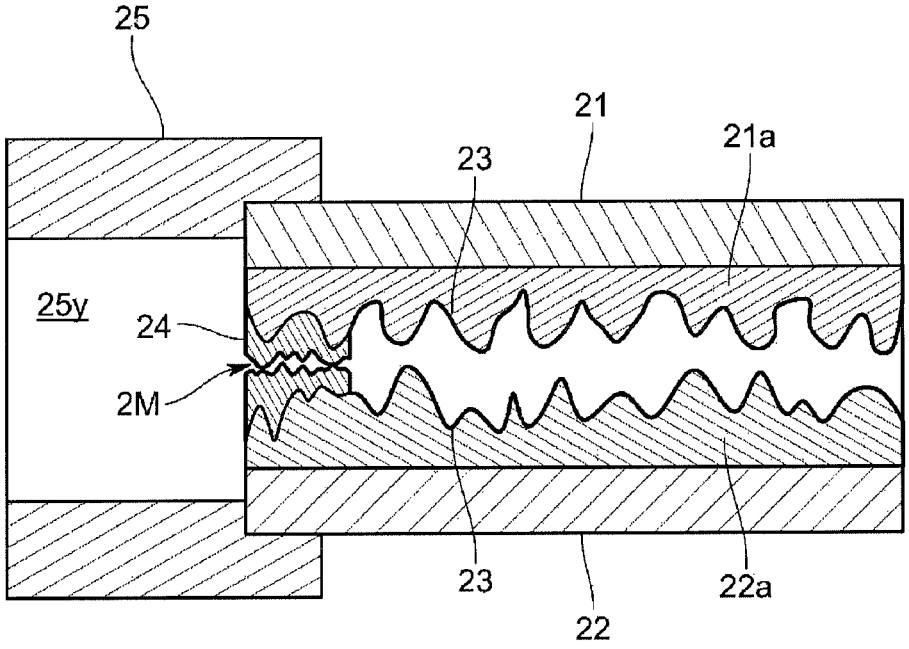
FIG. 26 is a magnified sectional view showing configuration of a casing of a plasma generating apparatus according to an embodiment modified from the embodiment shown in FIG. 16.

Furthermore, although the gas flow path 25*x* having a vertically-arranged inlet and outlet is formed in the casing 25 according to the above embodiment, a gas flow path 25*y* that is laterally opened in a sidewall of the casing 25 in correspondence to the lateral opening 2M may be formed, as shown in FIG. 26. Therefore, air may also be provided to the lateral opening 2M, and thus the drying efficiency of the dielectric layers 21*a* and 22*a* may be improved.

Figure 27:
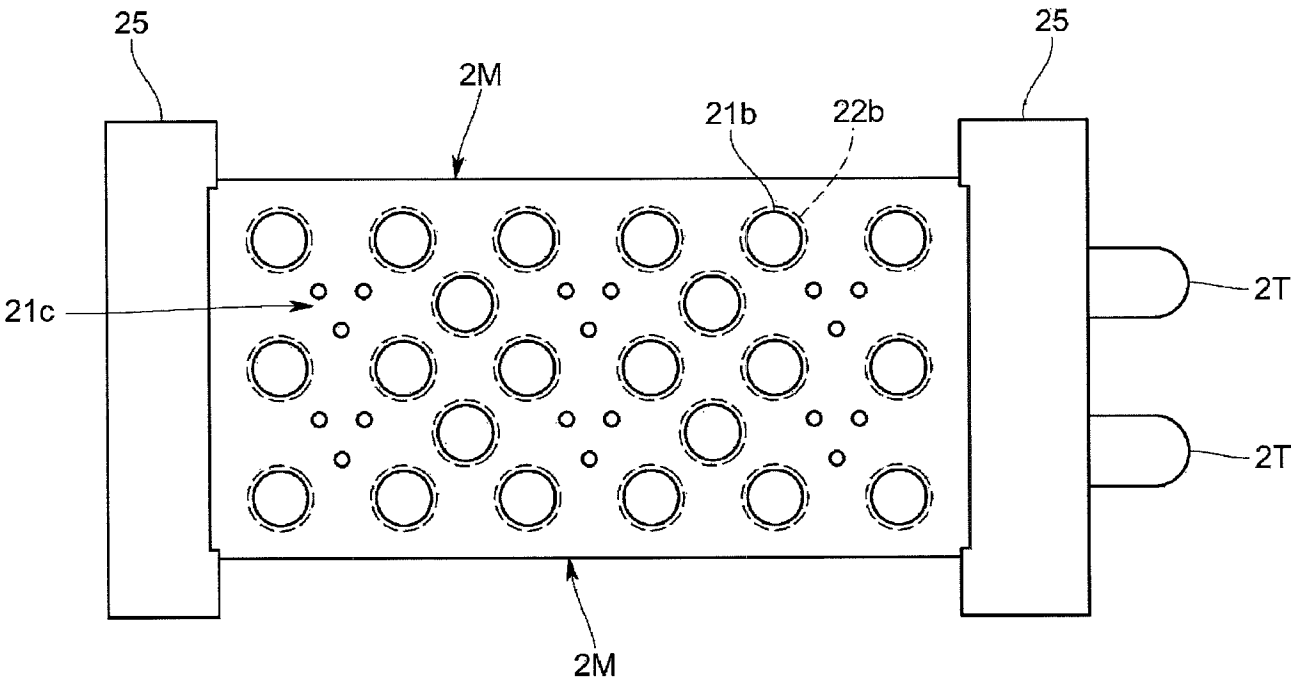
FIG. 27 is a plan view of a plasma electrode unit of a plasma generating apparatus according to an embodiment modified from the embodiment shown in FIG. 16.

As shown in FIG. 27, the casing 25 may support the leading sides and the rear sides of the pair of electrodes 21 and 22 and does not support two opposite lateral sides of the electrodes 21 and 22. In this case, the lateral openings 2M in the two opposite sides may be almost completely opened, and thus the drying efficiency of the dielectric layers 21*a* and 22*a* may be improved. Furthermore, the casing 25 may support four corners of the pair of electrodes 21 and 22, and thus the lateral openings 2M are formed in all sides of the pair of electrodes may be almost completely opened.

The heating element may be arranged in the casing 25 or the pair of electrodes 21 and 22. Therefore, in addition to the effect of accelerating evaporation of dew water by opening the lateral openings, evaporation of dew water may be further accelerated by the heating effect of the heating elements, and thus dielectric layers may be dried faster. Particularly, in a case of appliances, such as a refrigerator, heating elements may be efficiently operated with minimum energy by being linked with a sensor, such as a humidity sensor or a temperature sensor.

Although the plurality of the fluid flowing holes 21*b* in the electrode 21 have the same shape and the plurality of the fluid flowing holes 22*b* in the electrode 22 have the same shape in the above embodiments, the fluid flowing holes 21*b* or 22*b* may have different shapes.

Although all of the fluid flowing holes 21*b* in the electrode 21 are formed to be smaller than the plurality of fluid flowing holes 22*b* of the electrode 22 in the above embodiments, some of the fluid flowing holes 21*b* in the electrode 21 may be formed to be smaller than the fluid flowing holes 22*b* in the electrode 22, and the remaining fluid flowing holes 21*b* in the electrode 21 may be formed to be larger than the fluid flowing holes 22*b* in the electrode 22.

Although a penetration hole is formed in the electrode 21 or the electrode 22 in the above embodiments, penetration holes (semi-openings) may be formed in both of the electrodes 21 and 22.

The fluid flowing holes have the same cross-sectional shape in the above embodiments, the fluid flowing holes may have a tapered shape, a mortar-like shape, or a bow-like shape. In other words, the fluid flowing holes may be widened or narrowed from an opening to the other opening.

The fluid flowing holes may have any of various cross-sectional shapes, such as a circle, an ellipse, a rectangle, a straight slit, a concentric-circular slit, a wavy slit, a crescent, a comb, a honeycomb, or a star.

While the present invention has been particularly shown and described with reference to exemplary embodiments thereof, it will be understood by those of ordinary skill in the art that various changes in form and details may be made therein without departing from the spirit and scope of the present invention as defined by the following claims.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A plasma generating apparatus comprising:

a pair of electrodes having surfaces facing each other;

a dielectric layer disposed between the pair of electrodes and comprising a first surface and a second surface, the first surface of the dielectric layer being arranged on at least one of the surfaces facing each other; and a coating film arranged on the second surface of the dielectric layer, the coating film configured to prevent condensation and moisture attachment on the dielectric layer, wherein plasma discharge occurs as a predetermined voltage is applied to the pair of electrodes.

2. The plasma generating apparatus of claim 1, wherein the dielectric layer is formed using a thermal spraying method.

3. The plasma generating apparatus of claim 1, wherein the coating film is water-repellent.

4. The plasma generating apparatus of claim 1, wherein a thickness of the coating film is from about 0.01 μm to about 100 μm.

5. The plasma generating apparatus of claim 1, further comprising:

a spacer having a thickness of about 500 μm or less, which is arranged between the pair of electrodes.

6. The plasma generating apparatus of claim 5, wherein the spacer is formed using a thermal spraying method.

7. The plasma generating apparatus of claim 5, wherein the coating film is arranged on a surface of the spacer.

8. The plasma generating apparatus of claim 1, further comprising a heating element arranged at least one of the pair of electrodes or the dielectric layer.

9. The plasma generating apparatus of claim 8, wherein the heating element is arranged in at least one of the pair of electrodes.

10. The plasma generating apparatus of claim 8, wherein the heating element is arranged between the electrode and the dielectric layer.

11. The plasma generating apparatus of claim 8, wherein the heating element is arranged in the dielectric layer.

12. The plasma generating apparatus of claim 8, wherein the heating element is formed on a portion of at least one of the first surface and the second surface of the dielectric layer.

13. The plasma generating apparatus of claim 8, wherein a heating temperature of the heating element is about 150° C. or less.

14. The plasma generating apparatus of claim 1, further comprising: a casing which supports the pair of electrodes, and a heating element for heating the electrode or the dielectric layer is formed at the casing.

15. The plasma generating apparatus of claim 14, wherein a heating temperature of the heating element is about 1500° C. or less.

16. The plasma generating apparatus of claim 1, further comprising: a casing supporting the pair of electrodes, the casing opens lateral openings formed between the pair of electrodes at least partially; and a plurality of fluid flowing holes are formed in each of the pair of electrodes, wherein the location of the fluid flowing holes corresponds to each other to penetrate through the electrodes.

17. The plasma generating apparatus of claim 16, wherein the casing comprises a wall unit facing the lateral opening, and a gas flow path is formed between the lateral opening and the wall unit.

18. The plasma generating apparatus of claim 17, wherein a penetration hole communicating with the lateral opening is formed in the casing, and the gas flow path is formed by the penetration hole.

19. The plasma generating apparatus of claim 16, further comprising an air- blowing mechanism, which is arranged at the leading ends or the rear ends of the pair of electrodes to provide air to the lateral opening.

20. A plasma generating apparatus comprising:

a pair of electrodes having surfaces facing each other;

a dielectric layer disposed between the pair of electrodes and comprising a first surface and a second surface, the first surface of the dielectric layer being arranged on at least one of the surfaces facing each other;

a heating element to heat the second surface of the dielectric layer, the heating element arranged to contact the dielectric layer, wherein plasma discharge occurs as a predetermined voltage is applied at the pair of electrodes, and wherein the heating element is electrically insulated from the pair of electrodes.

21. The plasma generating apparatus of claim 20, wherein the heating element is arranged in each of the pair of electrodes.

22. The plasma generating apparatus of claim 20, wherein the heating element is arranged between each of the electrodes and the dielectric layer.

23. The plasma generating apparatus of claim 20, wherein the heating element is arranged in the dielectric layer.

24. The plasma generating apparatus of claim 20, wherein the heating element is formed on a portion of surfaces of the dielectric layer.

25. The plasma generating apparatus of claim 20, wherein a heating temperature of the heating element is about to 150° C. or less.

26. The plasma generating apparatus of claim 20, wherein a coating film is arranged on a surface of the dielectric layer.

27. The plasma generating apparatus of claim 26, wherein the coating film is water-repellent.

28. The plasma generating apparatus of claim 26, wherein a thickness of the coating film is from about 0.01 μm to about 100 μm.

29. The plasma generating apparatus of claim 20, further comprising a spacer, which is arranged between the pair of electrodes and has a thickness smaller than or equal to 500 μm.

30. A method of generating plasma comprising:

preparing a pair of electrodes having surfaces facing each other, wherein a dielectric layer is disposed between the pair of electrodes and comprises a first surface and a second surface, the first surface of the dielectric layer is arranged on at least one of the surfaces facing each other;

applying a predetermined voltage to the pair of electrodes to occur plasma discharge;

heating the second surface of the dielectric layer by using a heating element, the heating element to contact the dielectric layer, wherein the heating element is electrically insulated from the pair of electrodes.

31. A method of generating plasma comprising:

preparing a pair of electrodes, wherein a dielectric layer is arranged on at least one of surfaces of the electrodes facing each other;

applying a predetermined voltage to the pair of electrodes to generate the plasma; and heating the pair of electrodes by applying voltage greater than the predetermined voltage to the pair of electrodes to heat the dielectric layer.

32. The plasma generating apparatus of claim 1, further comprising a metal mesh acting as an anti-explosion safety mechanism.

33. The plasma generating apparatus of claim 20, further comprising a metal mesh acting as an anti-explosion safety mechanism.

* * * * *

UNITED STATES PATENT AND TRADEMARK OFFICE

CERTIFICATE OF CORRECTION

PATENT NO. : 9,220,162 B2
APPLICATION NO. : 13/371997
DATED : December 22, 2015
INVENTOR(S) : Kazutoshi Takenoshita It is certified that error appears in the above-identified patent and that said Letters Patent is hereby corrected as shown below:

Claims

Column 18, Line 43-44, Claim 15
Delete "1500° C." and insert -- 150° C. --, therefor.

Column 20, Line 23, Claim 31
Delete "voltage" and insert -- a voltage --, therefor.

Signed and Sealed this
Seventeenth Day of May, 2016

Michelle K. Lee

Michelle K. Lee
*Director of the United States Patent and Trademark Office*